US006168037B1

(12) United States Patent
Grimard

(10) Patent No.: US 6,168,037 B1
(45) **Date of Patent: *Jan. 2, 2001**

(54) RESEALABLE VIAL WITH CONNECTOR ASSEMBLY HAVING A MEMBRANE AND PUSHER

(75) Inventor: Jean Pierre Grimard, Vif (FR)

(73) Assignee: Becton Dickinson France, S.A., Le Pont de Claix (FR)

( * ) Notice: Under 35 U.S.C. 154(b), the term of this patent shall be extended for 0 days.

This patent is subject to a terminal disclaimer.

(21) Appl. No.: 08/906,011

(22) Filed: Aug. 4, 1997

Related U.S. Application Data

(63) Continuation of application No. 08/534,755, filed on Sep. 27, 1995, now abandoned.

(51) Int. Cl.[7] ..... B65D 47/00

(52) U.S. Cl. ..... 215/301; 215/249; 215/302; 215/307; 215/310; 215/274; 215/DIG. 3

(58) Field of Search ..... 215/249, 301, 215/302, 307, 310, 274, DIG. 3; 604/411, 412, 413, 414, 415, 416, 89, 90, 91, 246, 249, 30, 33; 141/23, 24, 26, 27, 312, 319

(56) References Cited

U.S. PATENT DOCUMENTS

| | | | | |
|---|---|---|---|---|
| 2,607,503 | | 8/1952 | Sonnenberg . | |
| 2,953,132 | | 9/1960 | Richter et al. . | |
| 3,164,303 | * | 1/1965 | Trautmann | 604/89 X |
| 3,206,080 | | 9/1965 | Scislowicz . | |
| 3,356,093 | * | 12/1967 | Mohahon | 141/349 |
| 3,357,427 | * | 12/1967 | Wittke et al. | 141/27 X |
| 3,674,028 | | 7/1972 | Ogle . | |
| 3,779,371 | * | 12/1973 | Rovinski | 604/90 X |

(List continued on next page.)

FOREIGN PATENT DOCUMENTS

| | | |
|---|---|---|
| 501 172 | 2/1971 | (CH) . |
| 3618158A1 | 3/1987 | (DE) . |
| 0 406 374 B1 | 12/1990 | (EP) . |
| 1071487 | 3/1954 | (FR) . |
| 1487413 | 5/1967 | (FR) . |
| 4-115127 | 10/1992 | (JP) . |
| WO 95/03841 | 2/1995 | (WO) . |

*Primary Examiner*—Allan N. Shoap
*Assistant Examiner*—Niki M. Eloshway
(74) *Attorney, Agent, or Firm*—Allen W. Wark

(57) ABSTRACT

A resealable vial featuring a connector assembly having a membrane and a pusher for selectively opening or sealing the fluid passageway between the bottle and the connector end of a luer hub. The connector assembly includes a body disposed on said bottle, and means for communicating fluid such as a luer connector hub which may be separately provided with the body or formed integrally therewith. The luer connector hub features a connector end open for access by medical delivery instrument, and an opposed end which is disposed for fluid communication with a recess defined by the body. The body defines a recess having a fluid path with the open top of the bottle. A membrane, preferably formed from an elastomeric material, is secured across both the recess and the open top of the bottle, and may be retained between the top surface of the bottle and the body. The membrane preferably includes a central area sealing the recess from the open top of the bottle, with one or more fluid openings defined on a portion of the membrane outside of the central area. A pusher is located in the recess. A force exerted on the pusher deflects the membrane towards the interior of the vial, urging the membrane and fluid openings away from the body to open the fluid path between the bottle and the recess. The pusher may be structured to include one or more fluid pathways so as to facilitate fluid flow through the recess. A sealing rib may be provided around the portion of the periphery of the recess to enhance sealing contact between the central area of the membrane and the recess.

29 Claims, 19 Drawing Sheets

U.S. PATENT DOCUMENTS

| | | | | |
|---|---|---|---|---|
| 3,838,689 | * | 10/1974 | Cohen | 604/90 |
| 4,210,255 | * | 7/1980 | Pan | 220/203.15 |
| 4,672,996 | * | 6/1987 | Floyd et al. | 220/203.11 X |
| 4,822,351 | | 4/1989 | Purcell . | |
| 5,291,991 | | 3/1994 | Meyer . | |
| 5,348,548 | | 9/1994 | Meyer et al. . | |
| 5,352,196 | * | 10/1994 | Haber et al. | 604/90 |
| 5,358,501 | | 10/1994 | Meyer . | |
| 5,360,413 | | 11/1994 | Leason et al. . | |
| 5,423,791 | | 6/1995 | Bartlett . | |
| 5,425,465 | | 6/1995 | Healy . | |
| 5,487,737 | * | 1/1996 | Meyer | 604/403 |
| 5,494,170 | | 2/1996 | Burns . | |
| 5,620,434 | | 4/1997 | Brony . | |
| 5,702,019 | * | 12/1997 | Grimard | 215/301 |
| 5,871,110 | * | 2/1999 | Grimard et al. | 215/249 |

* cited by examiner

RESEALABLE VIAL WITH CONNECTOR ASSEMBLY HAVING A MEMBRANE AND PUSHER

This application is a continuation of application Ser. No. 08/534,755, filed Sep. 27, 1995 now abandoned.

I. FIELD OF THE INVENTION

The invention relates to a vial having a resealable connector assembly, and more particularly, to a vial with a resealable connector assembly employing a membrane and pusher for efficient transfer of fluid to or from the vial.

II. BACKGROUND

Dry drugs such as powdered or lyophilized drugs are typically stored in sealed bottles or vials. In practice, the drug is accessed shortly prior to use by rupturing or displacing the seal provided on the vial. A solvent solution such as saline is then introduced into the vial to reconstitute the powdered or lyophilized drug. Once reconstituted, the drug solution is extracted from the vial for use.

Some prior art vials of powdered or lyophilized drugs include a pierceable membrane secured across the open top of the prior art vial. The membrane is normally pierced by a needle in communication with the solvent. However, care must be taken to avoid the separation of membrane fragments when the seal is pierced, as these may be accidentally delivered to the patient. These seals typically must be pierced each time access to the solvent is desired, heightening the problems associated therewith.

Other prior art vials include rubber stoppers that are removed from or urged into the vial when delivering the solvent for reconstituting the drug. While in general these assemblies work well to safely store a lyophilized drug prior to reconstitution and use, the stoppers normally cannot be accessed once they have fallen into the vial; hence, these vials normally cannot be resealed employing the stopper originally provided. This may be problematic, for instance, where a practitioner may not desire or need to administer the entire dose of reconstituted drug held in the vial; the vial would typically need to be resealed against the ambient environment to preserve the sterility of the drug remaining in the vial. Thus, the structure of these prior art vials is not readily adapted to a vial capable of repeated opening and closing.

Stoppers are normally formulated from materials selected for compatibility with the drug stored in the vial. Hence, the stoppers typically pose no harm to the safety of the drug, whether lyophilized or reconstituted. However, the appearance of a stopper within the interior of the vial often leads to the perception—however flawed—that the drug will be adversely affected by the presence of the stopper. There may also be a perception that the presence of the stopper within the vial impedes good flow of the drug solution.

III. SUMMARY OF THE INVENTION

A resealable connector assembly for a vial or bottle is provided for resealable fluid access to and from the interior of a medical storage bottle. The connector assembly permits a practitioner repeated access to the drug held in the bottle while at the same time preserving its sterility. The bottle includes an interior, an open top in fluid communication with the interior, and a top surface disposed around portions of the bottle surrounding the open top. The top surface may be formed, for instance, as an annular rim around the open top.

The resealable connector assembly features a body disposed on the top surface of the bottle. The body defines a recess having a fluid path to and from the open top of the bottle. A fluid access device such as a luer connector hub is disposed on the body to provide fluid access to and from the recess. The luer connector hub includes a connector end configured for access by a component of a medical delivery device, and an opposed end in fluid communication with the recess. If desired, the body and the luer connector hub may be provided as separate components, or they may be integrally formed as one component.

The resealable connector assembly further includes a membrane disposed between the open top of the bottle and the recess defined by the body. The membrane, which may be formed from an elastomeric material such as various elastomers, natural or synthetic rubbers, or the like, preferably includes a central area having a width at least equal to the width defined by the recess. One or more openings or slits are disposed outside the central area to establish in resealable fashion the fluid path between the recess and the open top of the bottle. One or more sealing ribs may be disposed on the body about the periphery of the recess. The sealing ribs are preferably disposed for sealing contact with the membrane between the central area and the one or more openings. If desired, the sealing ribs may be provided on the membrane itself.

The membrane is displaceable between a sealing position, wherein the one or more sealing ribs engage the membrane between the central area and the one or more openings to close the fluid path, and an open position, wherein the one or more ribs are urged away from the membrane, opening the fluid path between the recess and the open top of the bottle.

The membrane may be supported between the body and the top surface of the bottle and held in place, for instance, by an annular clip retaining the body to the top surface of the bottle. If desired, the body and top surface of the bottle may be formed as an integral component, with the membrane secured in the integral component so as to be disposed between the recess and the open top of the bottle.

A pusher is located in the recess defined by the body. The pusher preferably includes a top end disposed adjacent the opposed end of the luer connector hub and a bottom end disposed for contact with the membrane. The pusher defines one or more fluid pathways between its top and bottom ends so as to facilitate fluid flow through the recess. The fluid pathways may be defined by the structure of the pusher; likewise, the pusher may define a width less than the width of the recess, such that a gap exists between the pusher and the recess, establishing the fluid pathway.

If desired, a luer lock seal may be provided which is threadably engageable with the connector end of the luer connector hub. The luer lock seal serves to preserve sterility and prevents inadvertent access to the interior of the bottle until use is desired.

In use, the luer lock seal (if provided) is removed by the practitioner, so that the connector end of the luer connector hub is disposed for access by the medical delivery device. The medical delivery device may feature a male luer tip which is insertable through the connector end of the luer connector hub. The male luer tip will exert a force against the pusher, such that the pusher will displace the membrane towards the interior of the bottle. The one or more ribs will be displaced from their sealing contact with the body, opening the fluid path between the recess and the open top of the bottle, and thereby permitting fluid flow between the medical delivery device and the interior of the bottle via the recess and the fluid path defined between the recess and the open top of the bottle. Upon removing the medical delivery device from contact with the pusher, the membrane will re-deflect towards its closed position, such that the one or more ribs will be re-disposed for sealing contact with the membrane, closing the fluid path.

The pusher may assume a variety of configurations. Notably, the pusher may be formed as an elongate plug having a top end disposed through the opposed end of the luer connector hub, and a bottom end disposed for contact with the membrane. At least one outwardly protruding notch may be formed between the top and bottom ends of the plug. The recess may be formed with a main portion and top and bottom ends that display a width narrower than the width of the main portion. The width defined by the notch is greater than the width of the top and bottom ends of the recess. Thus, the notch serves to prevent inadvertent withdrawal of the plug from the recess. Moreover, the notch may cooperate with either the top or bottom ends of the recess as a second way to seal the device.

IV. BRIEF DESCRIPTION OF THE DRAWINGS

The invention will now be described in greater detail by way of reference to the appended drawings, wherein.

Figure 2:
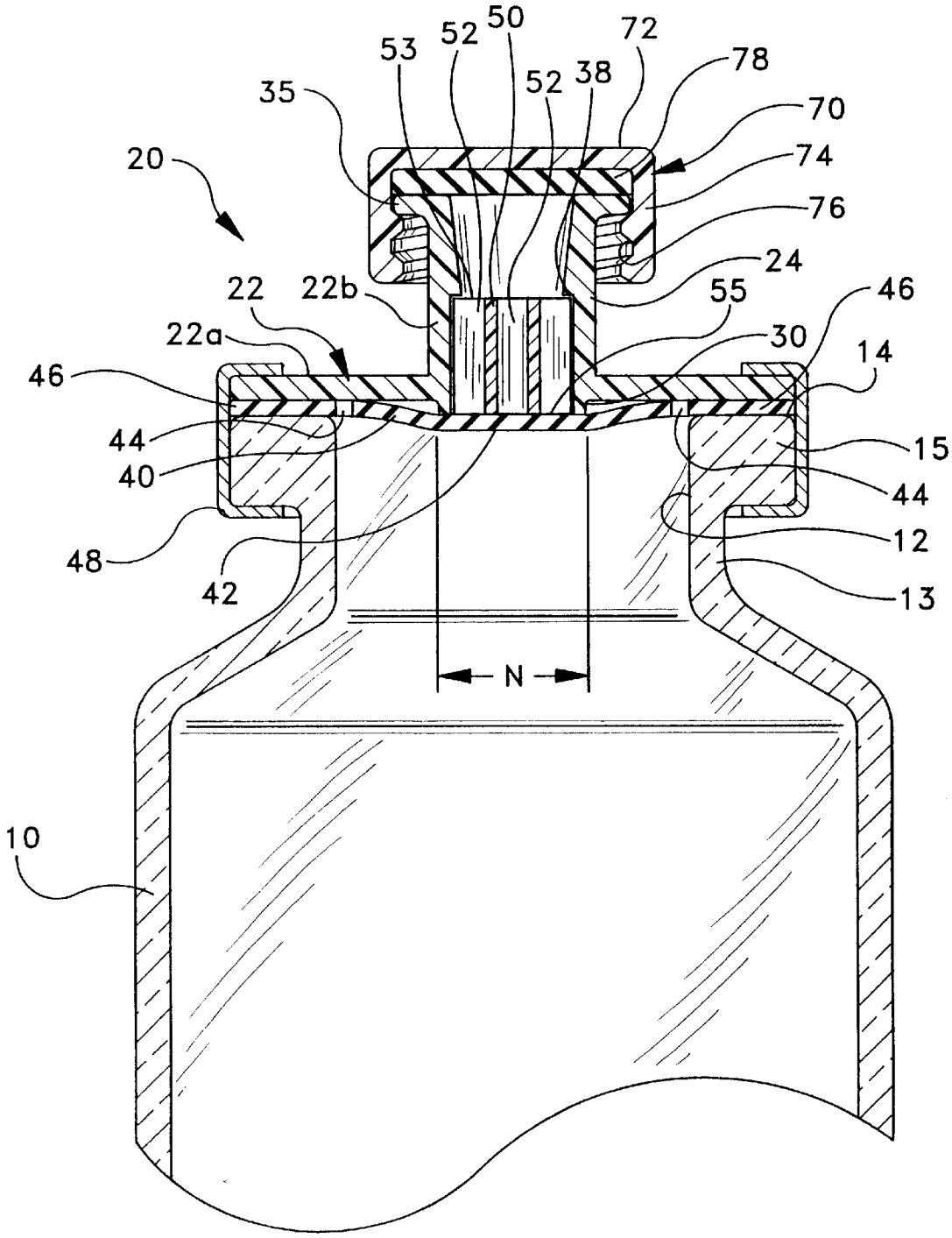
FIG. 2 is a cut-away view depicting one embodiment of a resealable bottle assembly in accordance with the invention.
Figure 2A:
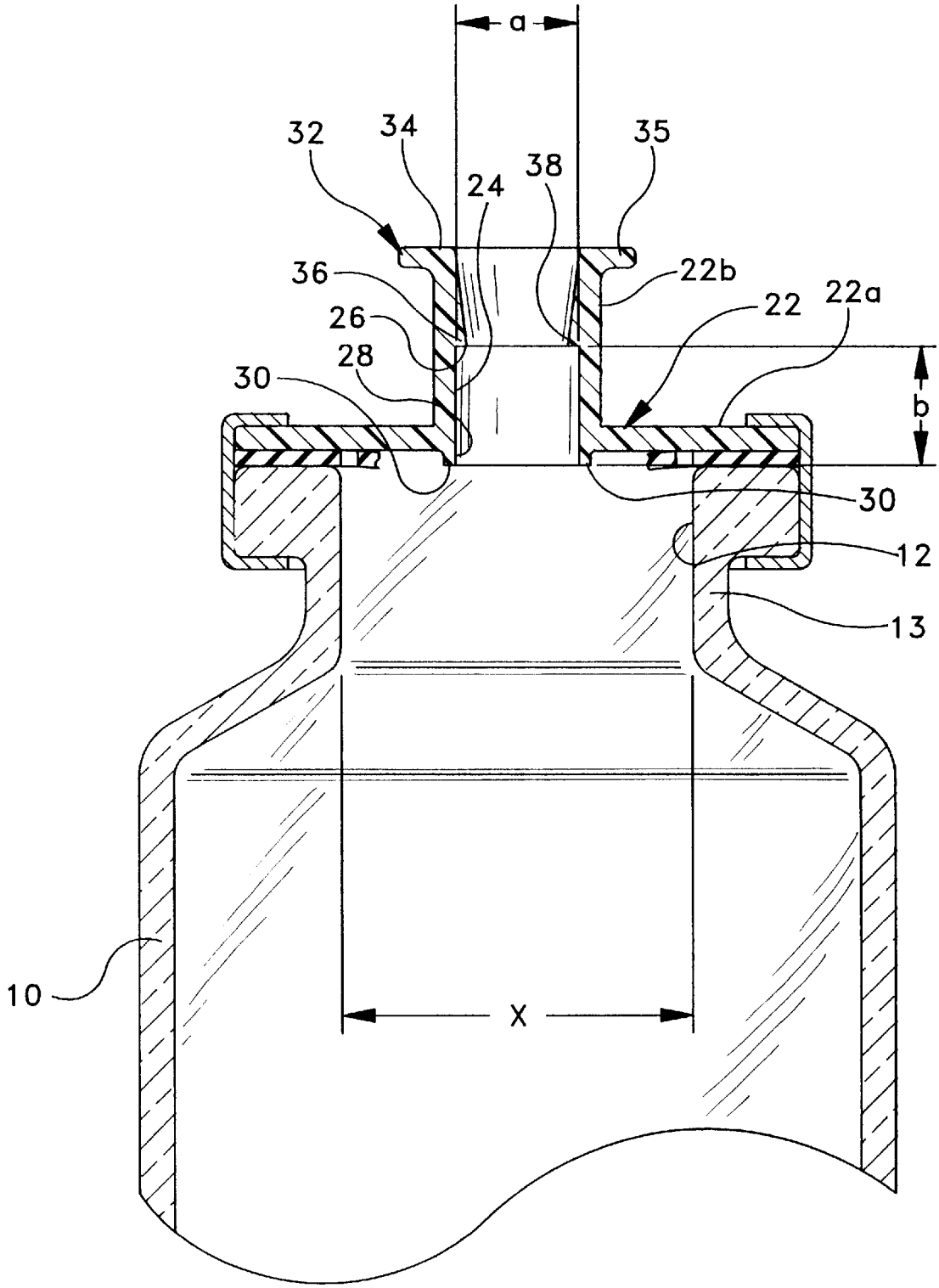
Figure 3:
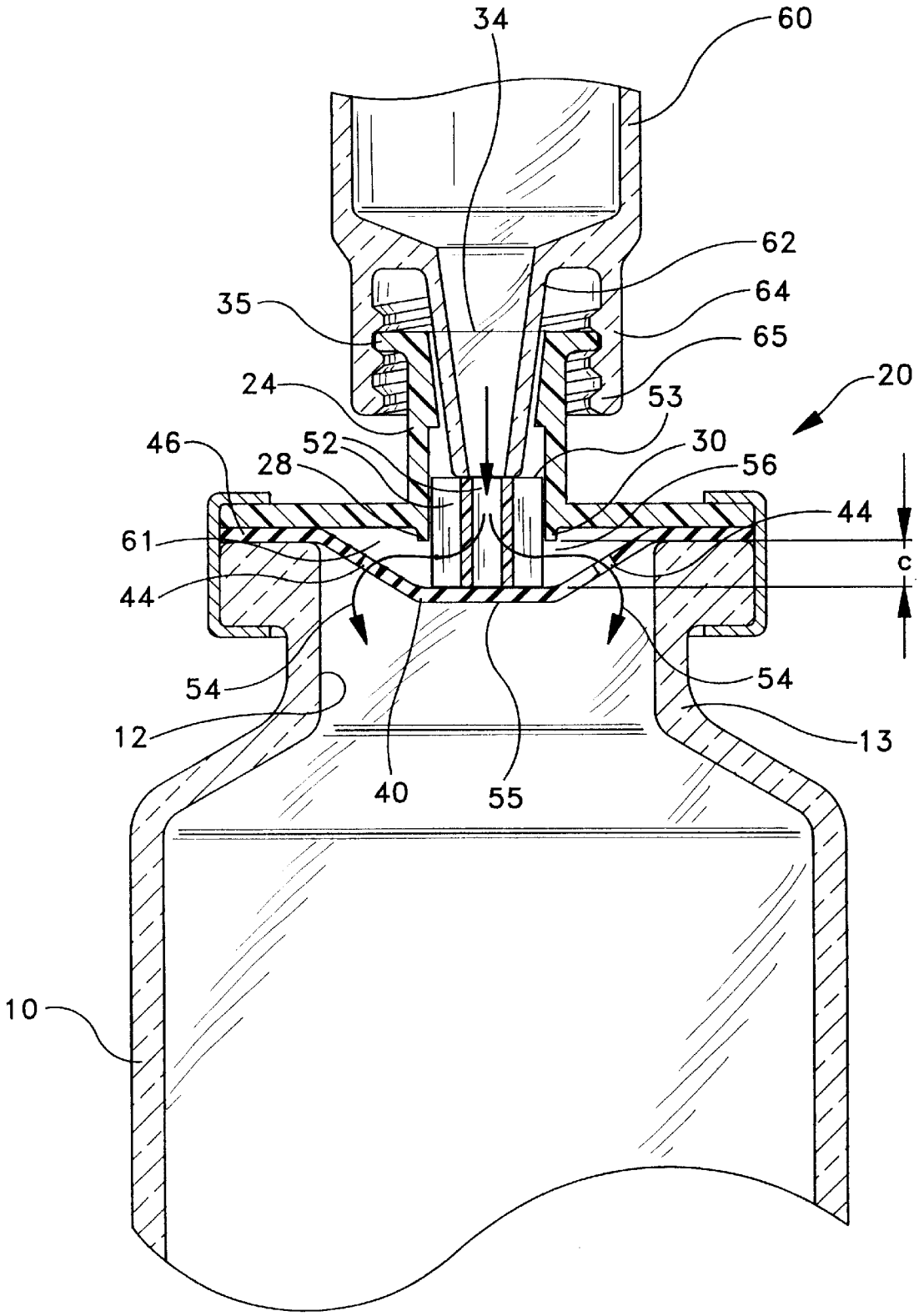
Figure 4:
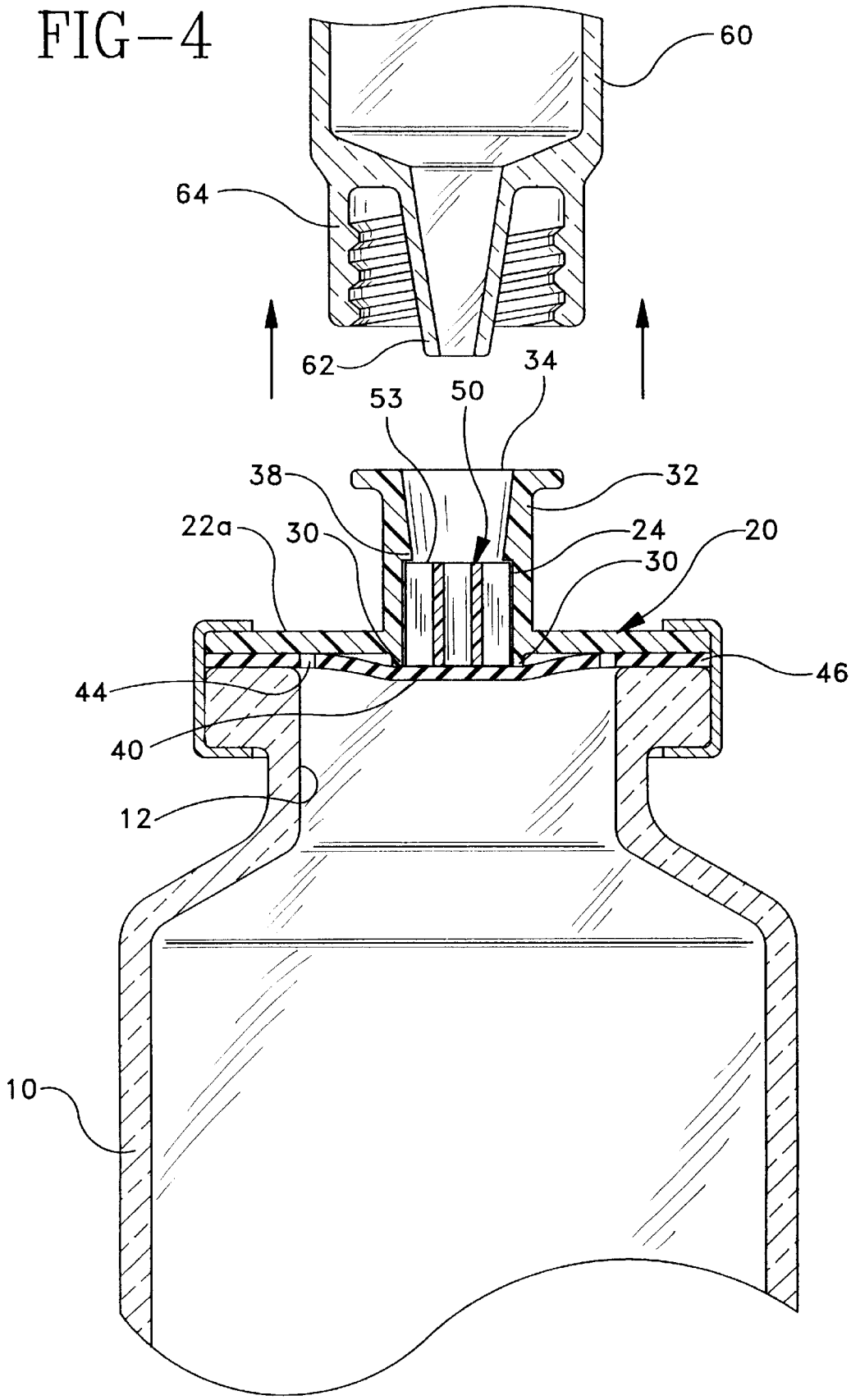
Figure 5:
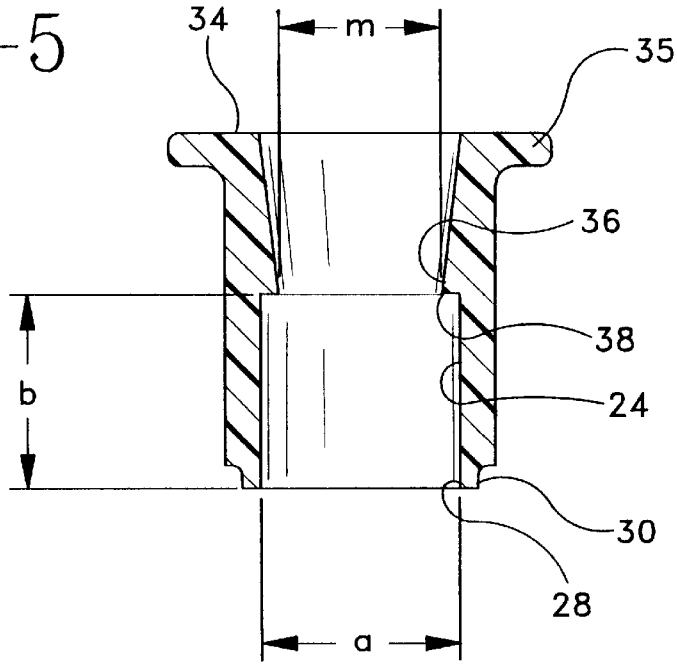
Figure 6:
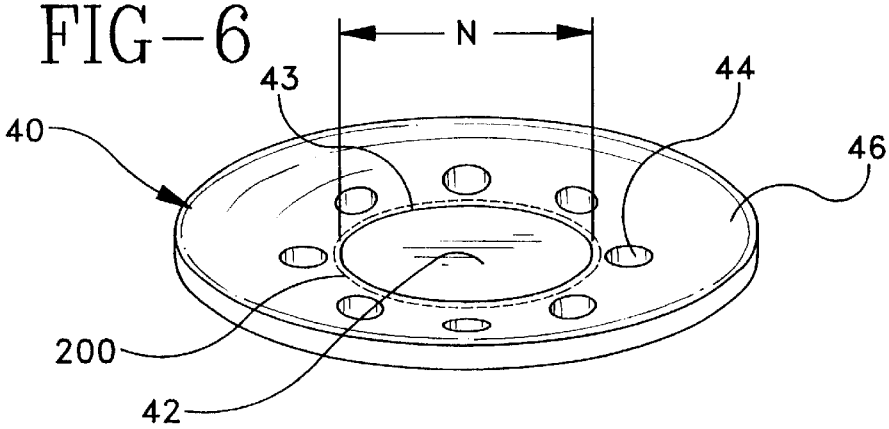
Figure 6A:
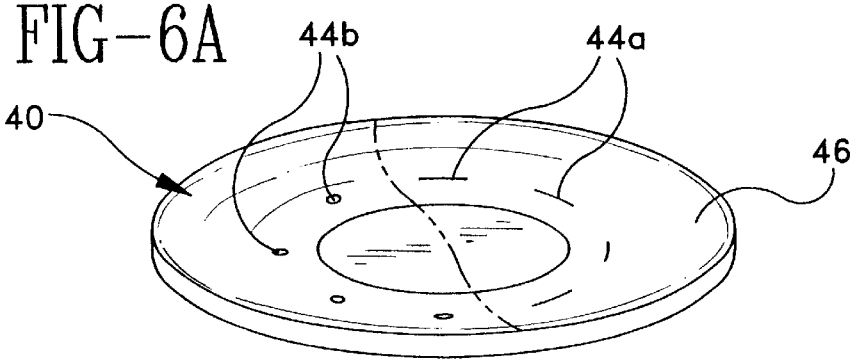
Figure 7:
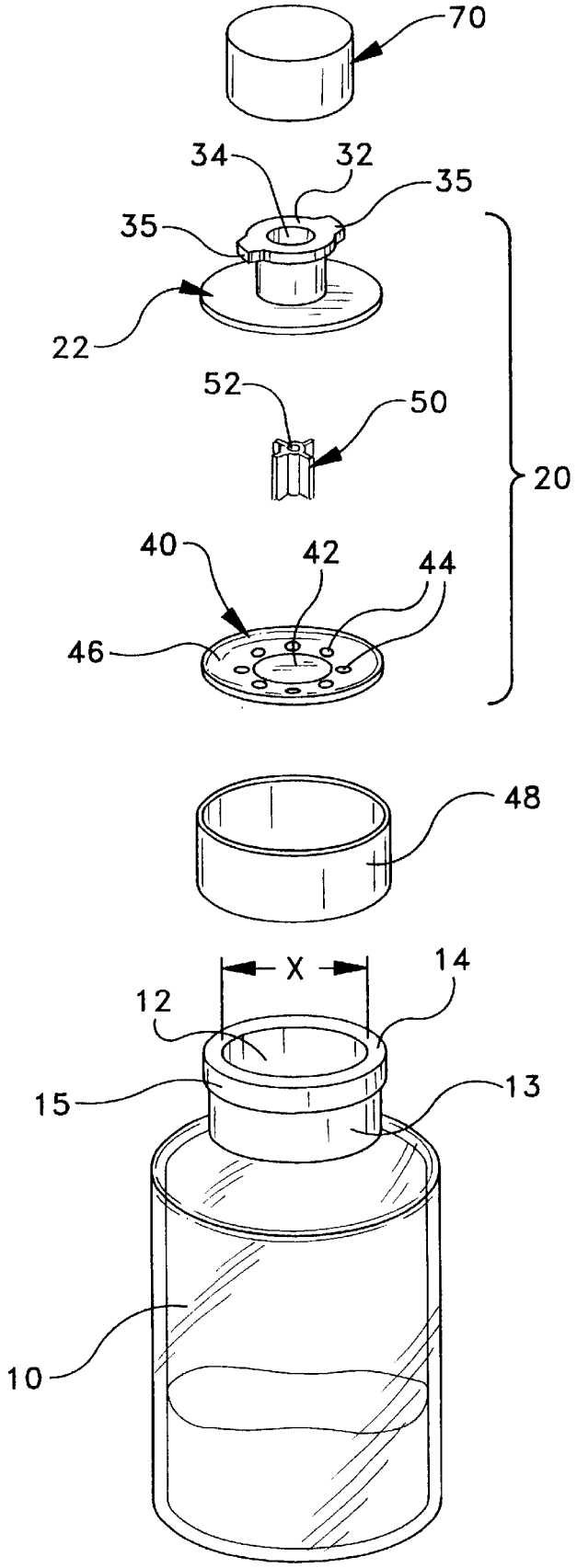
Figure 8:
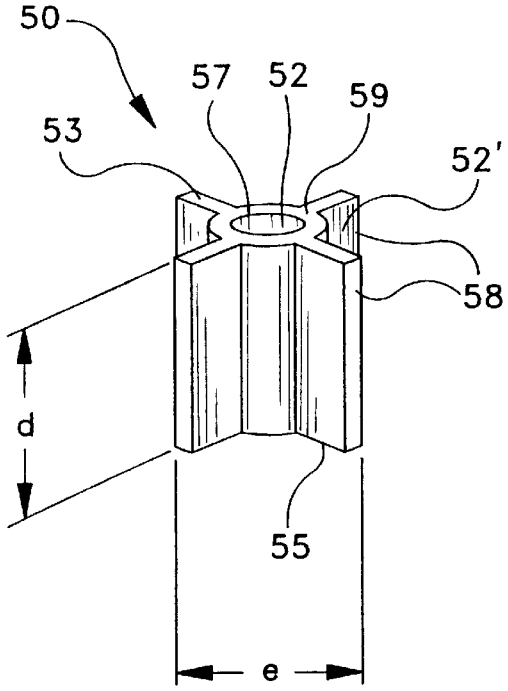
Figure 9:
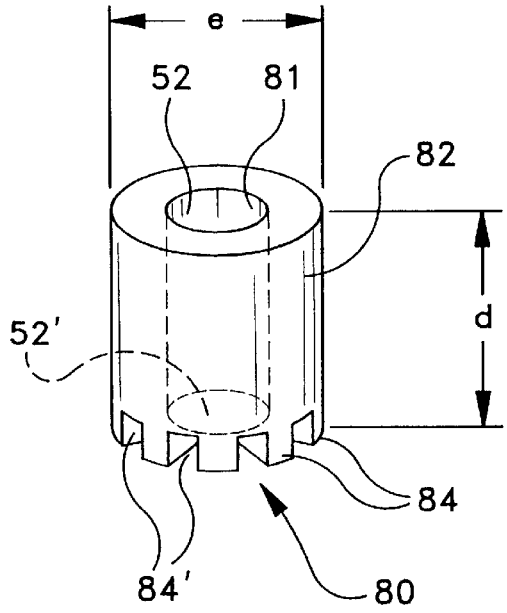
Figure 10:
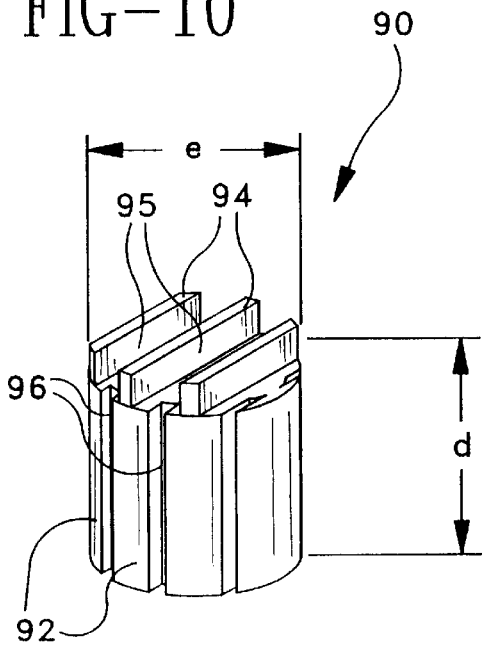
Figure 11:
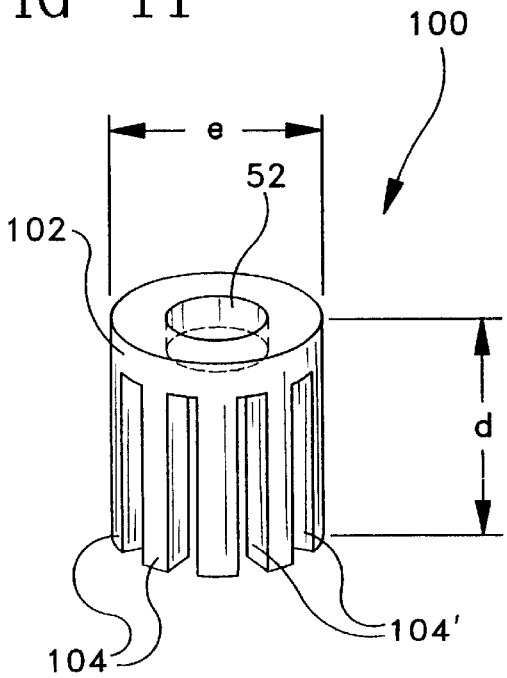
Figure 12:
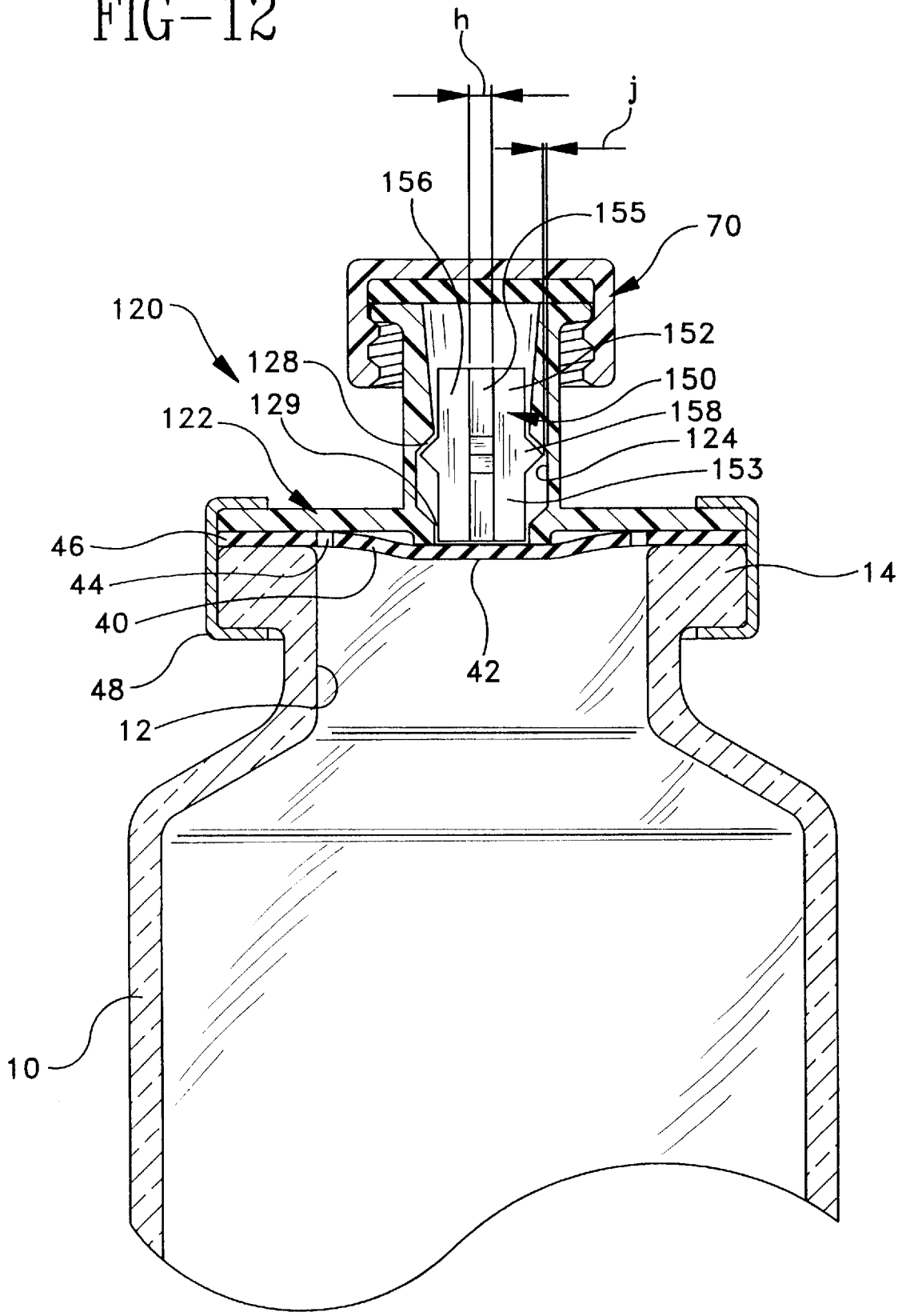
Figure 13:
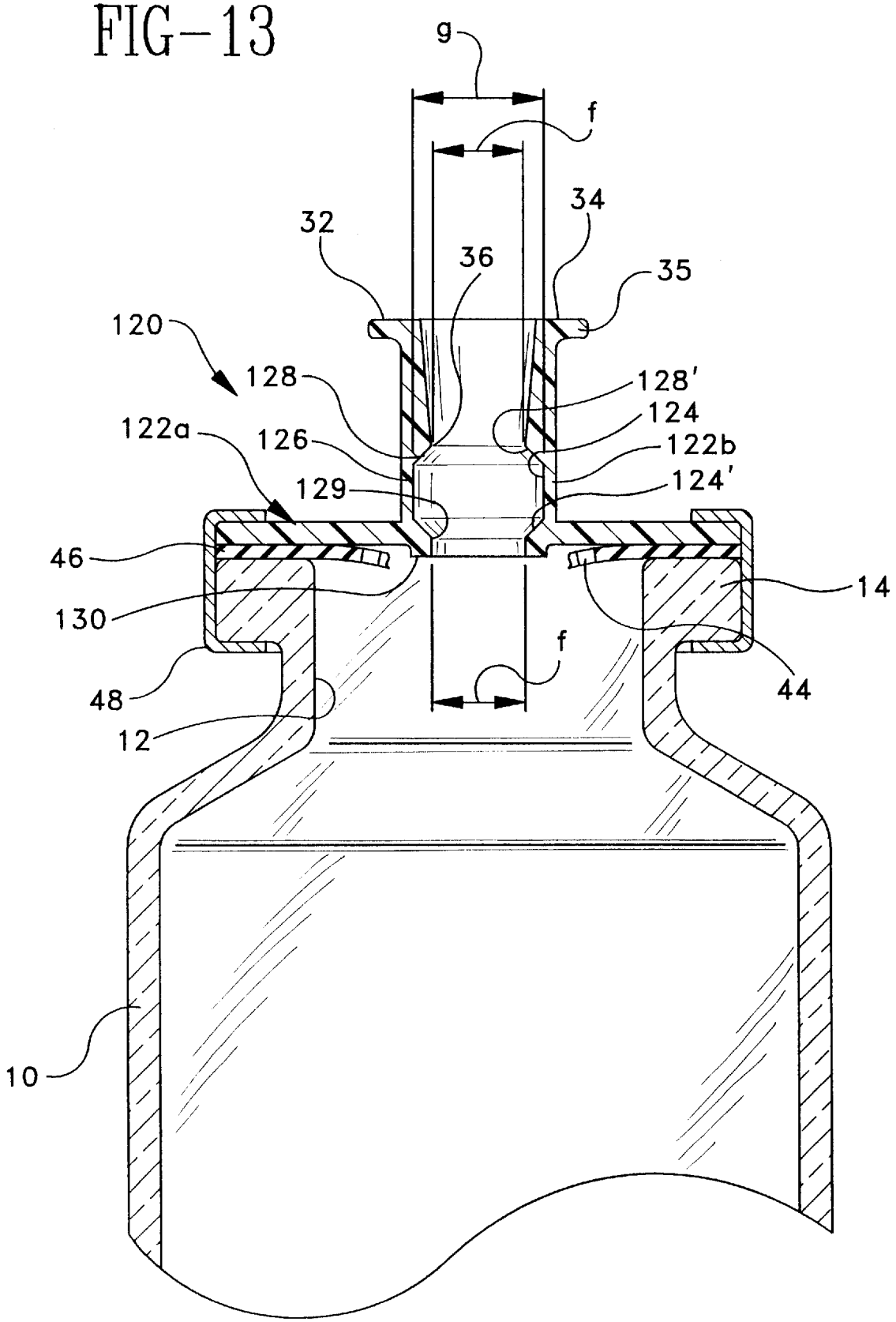
Figure 14:
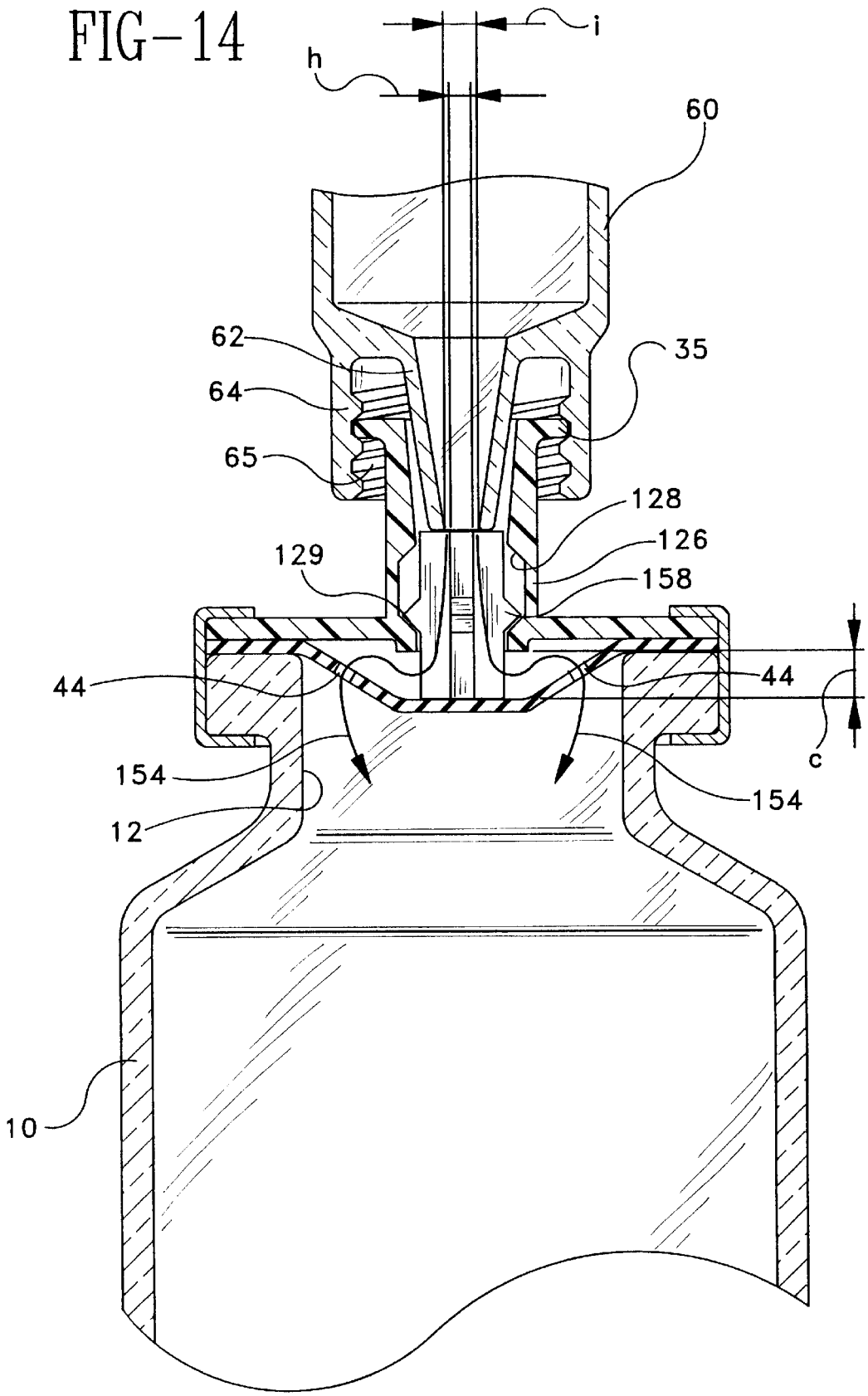
Figure 15:
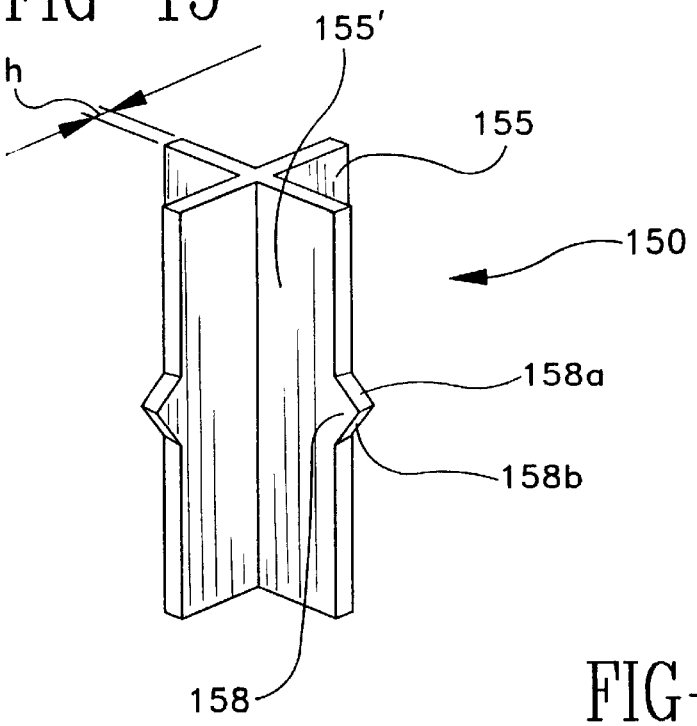
Figure 16:
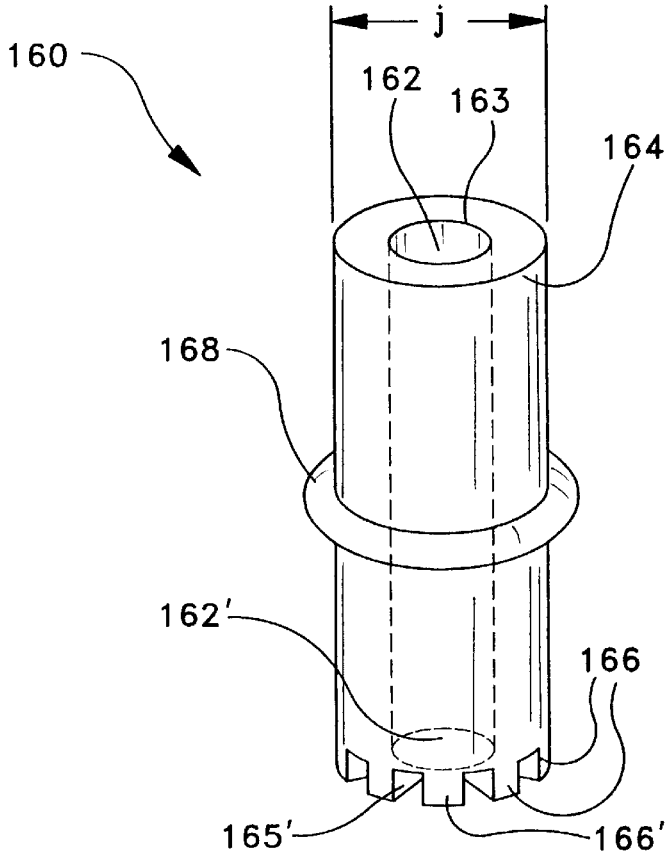
Figure 17:
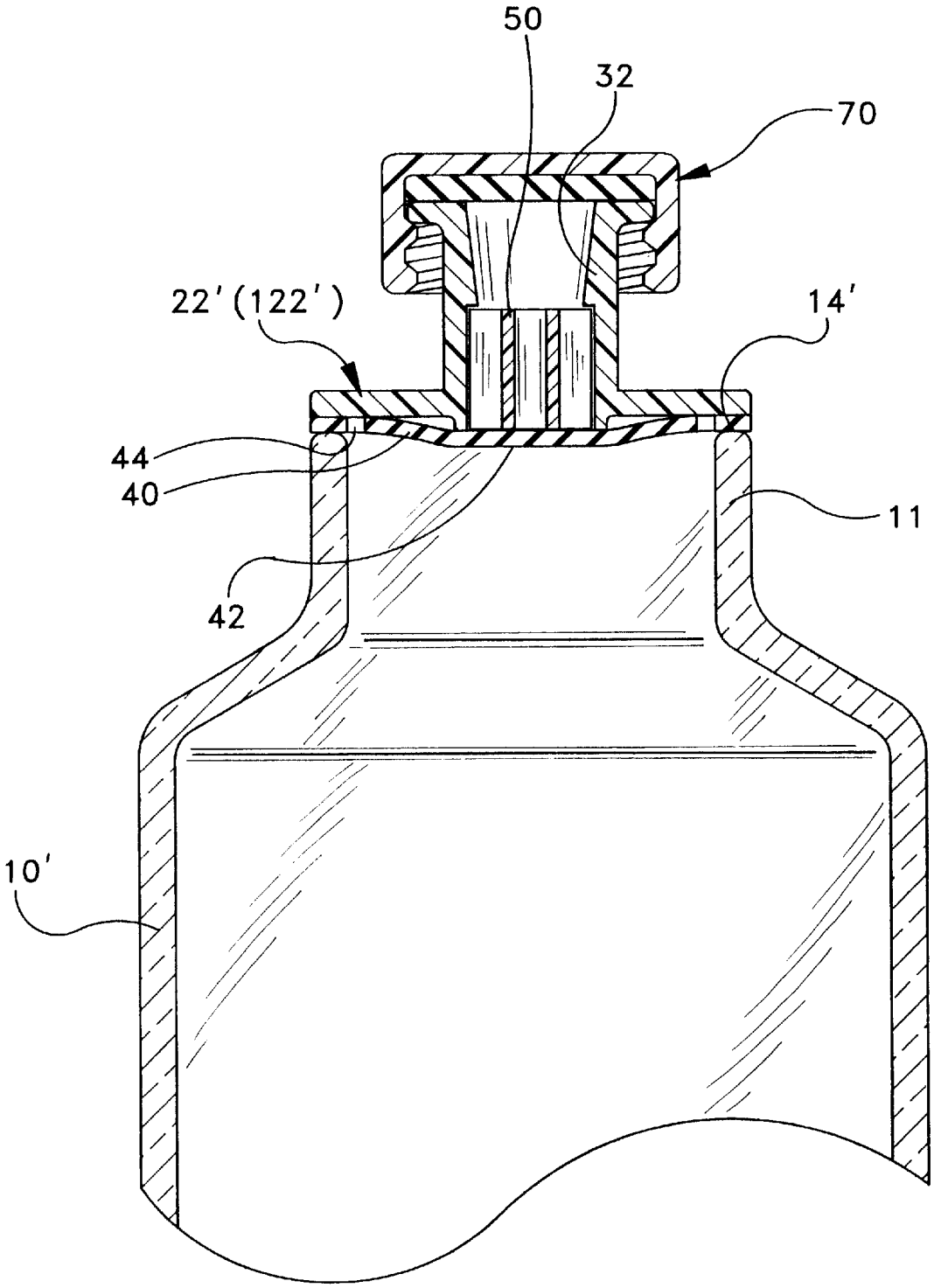
Figure 18:
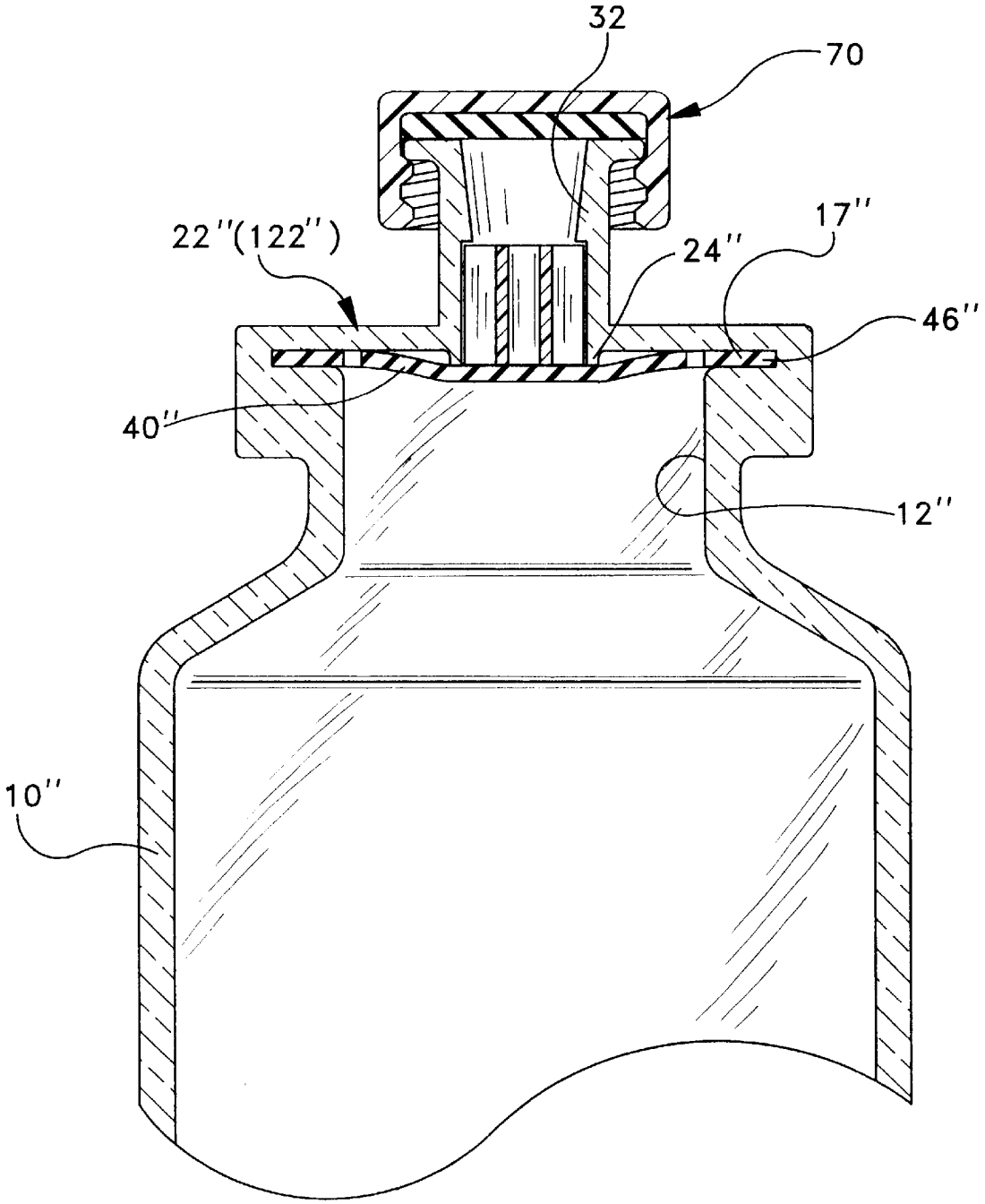
Figure 19:
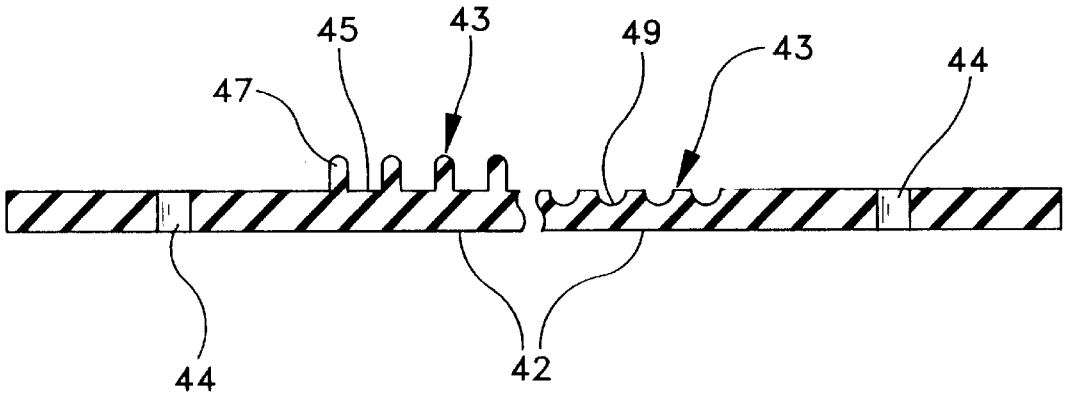
Figure 20A:
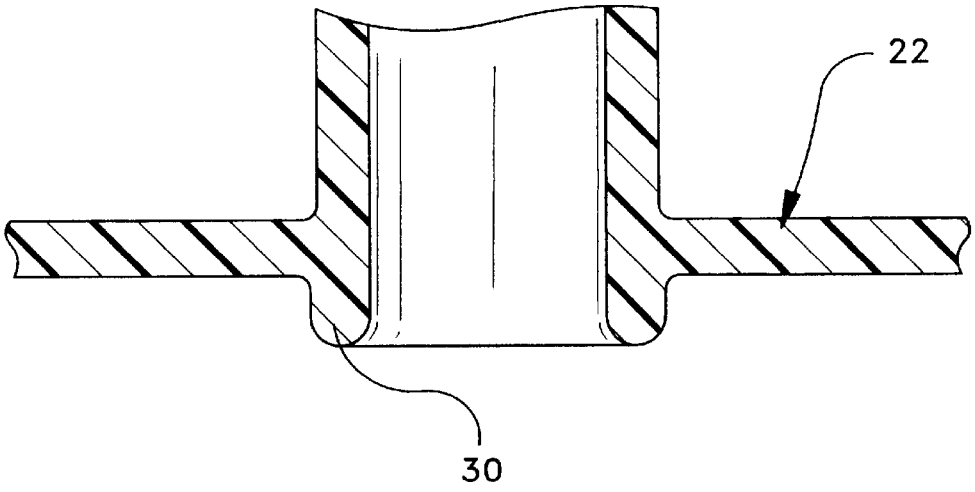
Figure 20B:
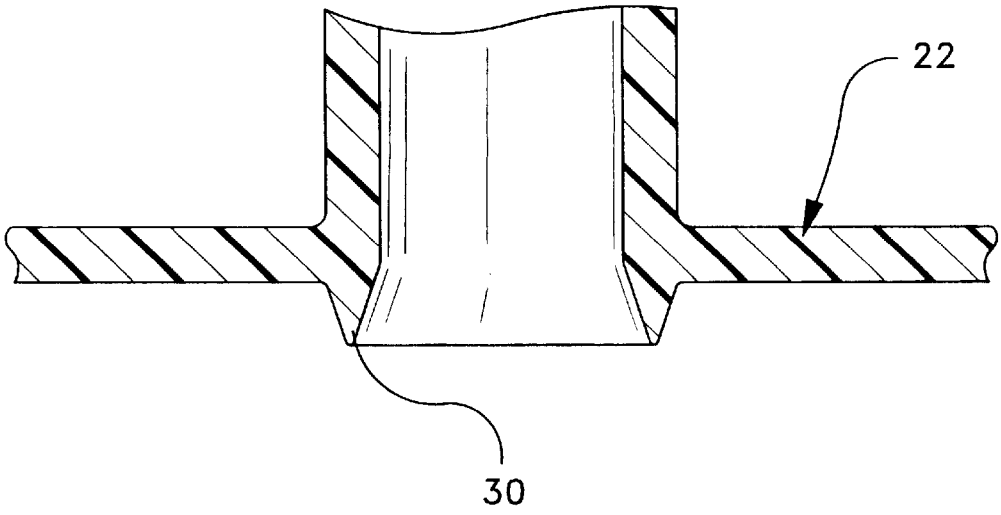
Figure 20C:
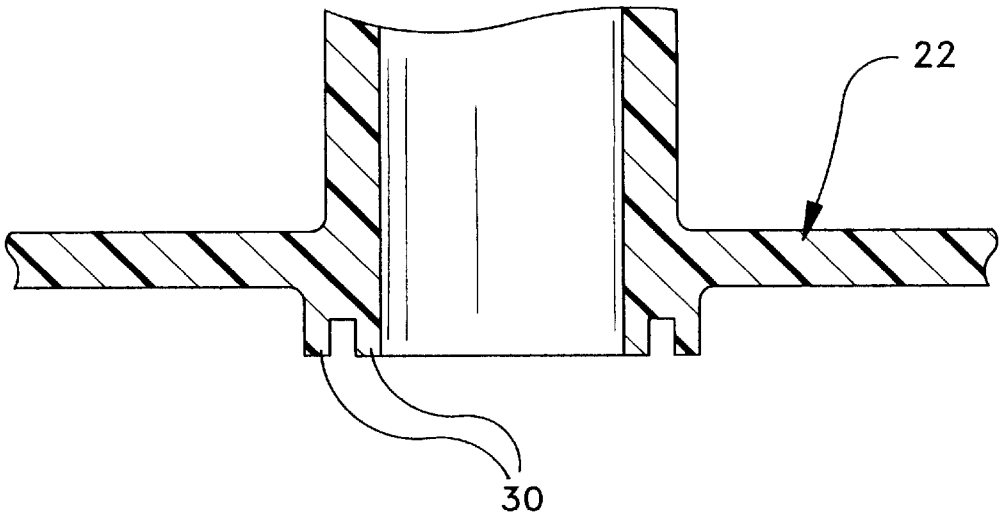
Figure 21A:
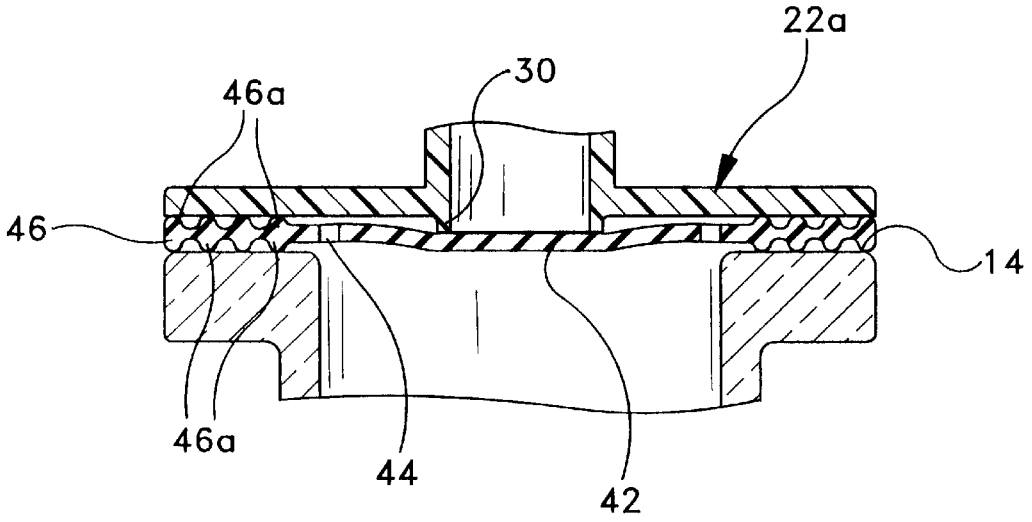
Figure 21B:
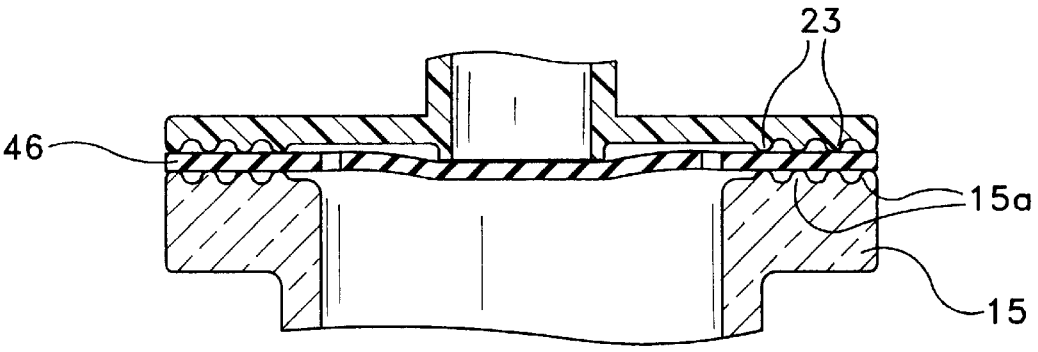
Figure 21C:
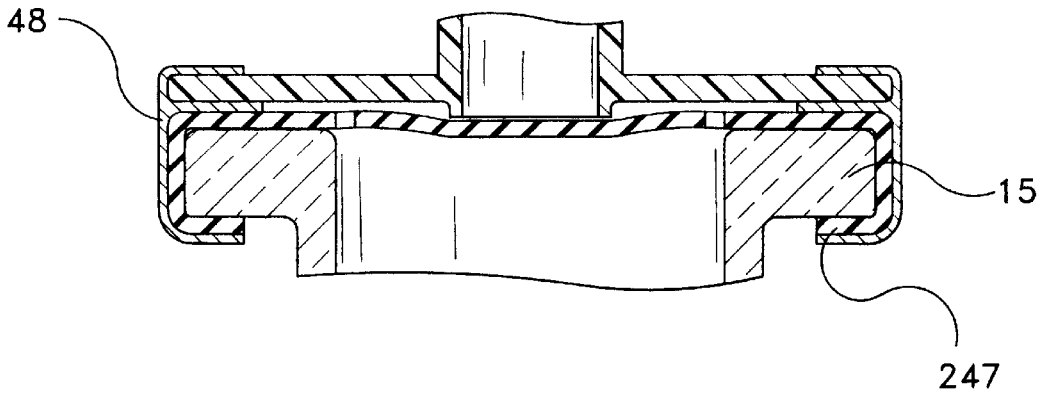
Figure 21D:
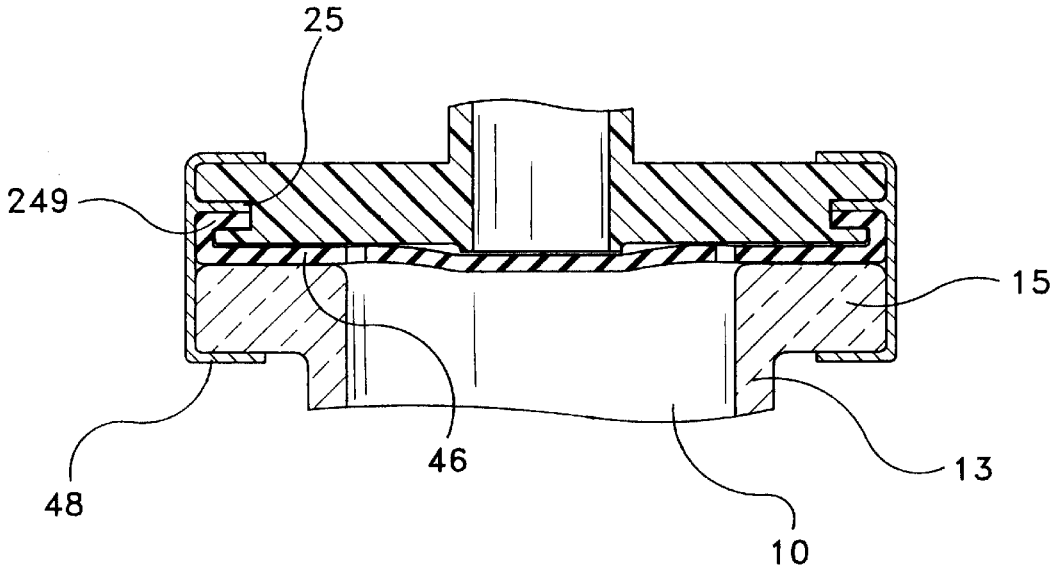
Figure 22:
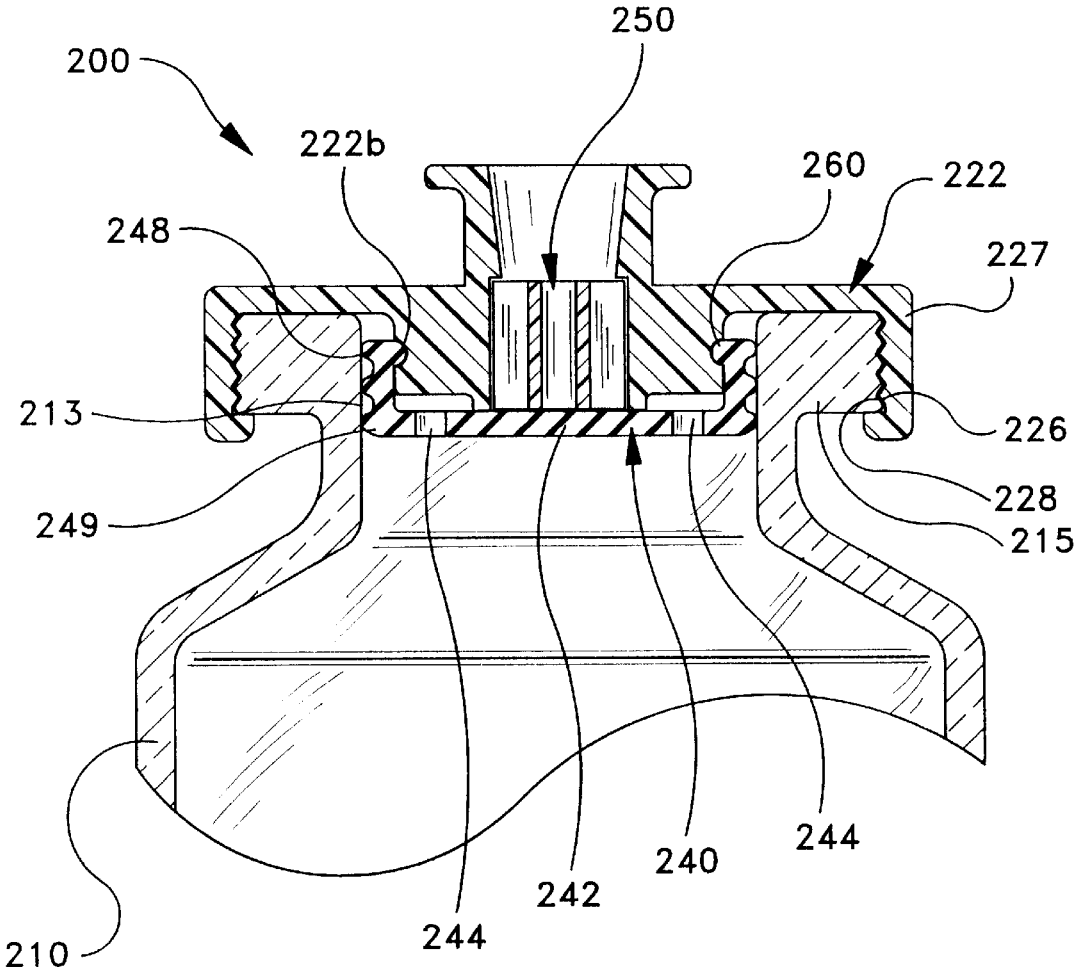

FIG. 2*a* is a second, partial cut-away view of the resealable bottle assembly depicted in FIG. 2;

FIG. 3 is another cut-away view of the resealable bottle assembly depicted in FIG. 2, illustrating displacement of the membrane to its open position by action of the medical delivery device, thereby opening the fluid path between the recess and the open top of the bottle;

FIG. 4 is another cut-away view of the resealable bottle assembly of FIG. 2, illustrating re-sealing of the membrane;

FIG. 5 is a partial view, in perspective, depicting the recess and luer connector hub illustrated in FIGS. 2–4;

FIG. 6 depicts one embodiment of the membrane illustrated in FIGS. 2–4;

FIG. 6A illustrates a variant of the membrane illustrated in FIG. 6;

FIG. 7 is an exploded perspective view of the resealable bottle assembly depicted in FIGS. 2–4;

FIG. 8 depicts one embodiment of a pusher employed with the resealable bottle assembly of FIG. 2;

FIG. 9 depicts a second variant of a pusher for the resealable bottle assembly of FIG. 2;

FIG. 10 depicts a further variant of a pusher for the resealable bottle assembly of FIG. 2;

FIG. 11 depicts a further variant of a pusher for the resealable bottle assembly of FIG. 2;

FIG. 12 is a cut-away view of a second embodiment of a resealable bottle assembly in accordance with the invention;

FIG. 13 is a cross-sectional view of the resealable bottle assembly depicted in FIG. 12, absent the pusher;

FIG. 14 is a cross-sectional view of the resealable bottle assembly depicted in FIG. 12, illustrating displacement of the membrane to its open position to open the fluid path between the recess and the open top of the bottle;

FIG. 15 depicts one variant of a pusher employed with the resealable bottle assembly illustrated in FIG. 12;

FIG. 16 is a second variant of a pusher employable with the resealable bottle assembly of FIG. 12;

FIG. 17 depicts a rimless bottle employable with the resealable bottle assembly of the present invention;

FIG. 18 illustrates unitary manufacture of a body and bottle, and retention of the membrane therein, in accordance with the present invention;

FIG. 19 depicts the incorporation of fluid channels in the central area of the membrane;

FIGS. 20*a*–20*c* depict various alternate configurations for the sealing rib;

FIGS. 21*a*–21*d* depict various structures for enhancing retention of the membrane between the body and top surface of the bottle; and FIG. 22 illustrates an alternate way to retain the membrane.

V. DETAILED DESCRIPTION OF THE PREFERRED EMBODIMENTS

While the description and figures herein makes reference to a vial or bottle, it will be understood and appreciated by the skilled artisan that any type of container normally employed in the field of endeavor, such as capsules, jars or like vessels, are readily amenable to the advantages described herein. In addition, while herein described with regard to containers having a quantity of dry drug or medicament for reconstitution by liquid obtained from an external source, it will be appreciated by the skilled artisan that the invention is not so limited. For instance, the invention and may be applied to containers holding a quantity of liquid medication, wherein repeated access is desired by a user.

Figure 1:
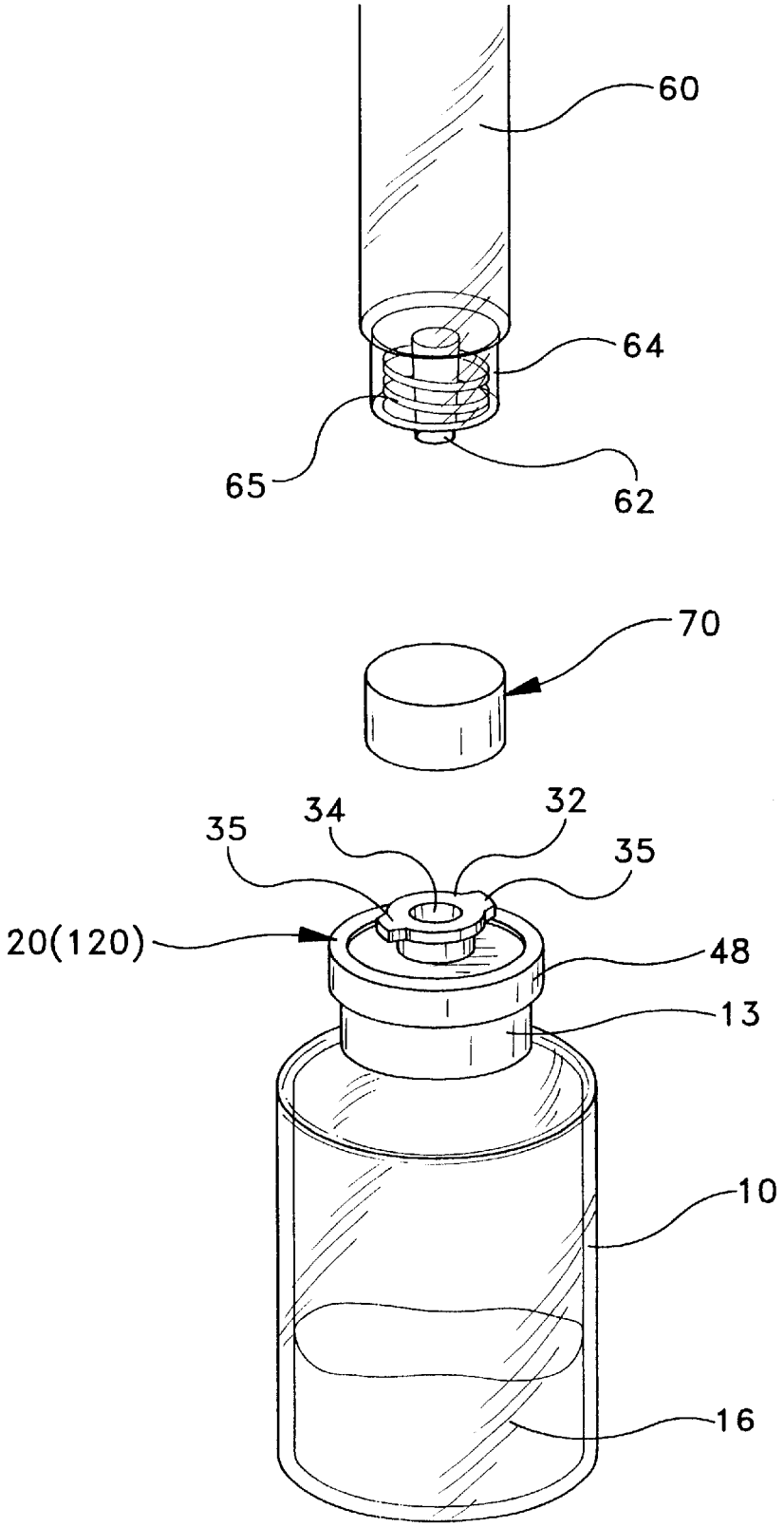
FIG. 1 is a blow-up view in perspective of a resealable bottle assembly affixed to a bottle containing therein a drug, with a medical delivery device such as a syringe employed to deliver fluid to the drug.

Turning now to the drawings, wherein like numerals depict like components, FIGS. 2–7 and FIGS. 12–14 depict, respectively, two alternate embodiments 20, 120 of a resealable bottle assembly in accordance with the present invention. FIG. 1 is an exploded perspective view of either resealable bottle assembly 20 (or 120) mounted to a bottle or vial 10 containing therein a drug 16. Drug 16 may entail, for instance, a medicament in powdered or granular form, such as a lyophilized medicament, intended to be reconstituted by a fluid introduced into vial 10 by a medical delivery device such as syringe 60. Alternately, it will be appreciated by the skilled artisan that drug 16 may entail a liquid medicament to which repeated access by the practitioner is desired.

Syringe 60 may feature, for instance, a male luer tip 62 for introducing fluid into the interior of bottle 10 via a luer connector hub 32 associated with the resealable bottle assembly 20 (or 120), as will be more fully described herein. Syringe 60 may also display a luer lock collar 64 surrounding luer tip 62. Internal portions of luer lock collar 64 may include a helicoidal thread 65 threadedly engageable with an edge 35 associated with luer connector hub 32. While syringe 60 is herein depicted as a luer lock syringe, it will be evident to 5 the skilled artisan that the invention is equally amenable to luer slip syringes. It will also be evident to the skilled artisan that syringe 60 may serve to aspirate reconstituted drug 16 from bottle 10.

As will be evident from the various drawings, bottle 10 may include a neck portion 13 defining an open top 12 with a width "X". Bottle 10 further preferably includes a top surface 14 disposed around open top 12. In the configuration depicted herein, top surface 14 is defined by an uppermost portion of an annular rim 15 formed around open top 12 of the bottle. It will be realized by the skilled artisan that the top surface of the bottle may also be established by rings or other means attached about open top 12 of the bottle.

FIGS. 2–7 depict one embodiment 20 of the resealable bottle assembly in accordance with the present invention. Resealable bottle assembly 20 features a body 22 having a relatively flat portion 22*a* and an upwardly extending portion 22*b*. As illustrated, body 22 defines therein a recess 24. As shown in FIGS. 2–7, body 22 may be formed separate from bottle 10, and attached to top surface 14 of the bottle by securing flat portion 22*a* to annular rim 15 with a crimp cap 48. It will also be evident to the skilled artisan that in lieu of a body separately supplied, body 22 may be unitarily formed with bottle 10. For instance, body 22 and, in particular, flat portion 22*a*, may define a contiguous extension of annular rim 15.

Recess 24, which includes a top end 26 and a bottom end 28, defines a height "b" and a width "a". Bottom end 28 of the recess is disposed for fluid communication with open top 12 of bottle 10. Width "A" of the recess is preferably less than width "X" defined by open top 12 of the bottle. For purposes which will be hereinafter more fully described, a sealing rib 30 may be provided about the periphery of bottom end 28 of the recess.

Resealable bottle assembly 20 includes means for introducing into or removing from bottle 10 fluids, by a medical delivery device such as syringe 60. Such means may entail, for example, a luer connector hub 32. The luer connector hub features a connector end 34 open for access by luer tip 62 of the syringe, and an opposed end 36 located adjacent top end 26 of recess 24. As illustrated in FIG. 5, opposed end 36 of the luer connector hub is in fluid communication with top end 26 of recess 24. Opposed end 36 of the luer connector hub may define a width "m" less than the width "a" of recess 24, such that a retaining edge 38 is defined between the recess and the luer connector hub. For purposes to be more fully described, retaining edge 38 serves to retain within recess 24, a pusher 50 forming a part of resealable bottle assembly 20.

It will be apparent to the skilled artisan that luer connector hub 32 may be supplied separately from body 22 and affixed thereto, for instance, by adhesives, welding, or like affixation methods. Likewise, it will be realized by the skilled artisan that, if desired, luer connector hub 32 may be unitarily formed with body 22.

Resealable bottle assembly 20 preferably features a membrane 40 which is displaceable between an open position (FIG. 3) and a closed position (FIGS. 2,4) relative to body 22. In the open position of the membrane, a fluid path 54 is opened between recess 24 and open top 12 of the bottle, permitting free fluid flow between syringe 60 and the interior of bottle 10. Likewise, fluid path 54 is closed when membrane 40 is returned to its closed position, preventing fluid flow between the recess and the open top of the bottle, and isolating the interior of bottle 10 from the ambient environment.

As depicted in FIGS. 2–4 and 6, membrane 40, which may be formed from an elastomeric material such as various thermoplastic elastomers, natural or synthetic rubbers, or the like, can be configured in a roughly cylindrical, planar manner. Membrane 40 includes an edge 46 securable between flat portion 22*a* of the body and top surface 14 of the bottle, for instance, by the force exerted by crimp cap 48. Membrane 40 preferably includes a central area 42 having a width "n" at least equal to width "a" of recess 24. Thus, when the membrane is secured to bottle 10, central area 42 is disposed fully across bottom end 28 of the recess.

Various structures may be incorporated to assist in the retention of membrane 40 between body 22 and the top surface of the bottle. For instance, ribs 46*a* (FIG. 21*a*) may be incorporated onto edge 46 to provide extra grip between flat portion 22*a* and annular rim 15. Likewise, ribs 23 and/or ribs 15*a* (FIG. 21*b*) may be incorporated on the flat portion and/or annular rim, respectively, for the same purpose. Alternately, as seen in FIGS. 21*c*, membrane 40 may include a flap 247 which is locked beneath annular rim 15 by the action of crimp cap 48. Likewise, the membrane might include a portion 249 wedged into a slot 25 defined in body 22 (FIG. 21*d*), enhancing the gripping action of the crimp clamp. Other variations will be envisioned by the skilled artisan.

One or more fluid passages may be provided in the membrane to effect fluid communication between the recess and the open top of the bottle. In one configuration, the one or more fluid passages entail one or more openings 44 are preferably defined on membrane 40 outside of central area 42. As seen in FIGS. 2–4, the one or more openings 44 are located on membrane 40 such that when the membrane is disposed in its closed position (FIGS. 2 and 4), sealing rib 30 will contact the membrane in a sealing area 43 defined between central area 42 and the one or more openings, thereby sealing recess 24 from fluid communication with open top 12 of the bottle. Additionally, membrane 40 may be designed or otherwise formed from an appropriate material such that when the membrane is in its closed position, the one or more openings 44 will rest flush against flat portion 22*a* of the body, further sealing the recess from the open top of the bottle.

It will be realized by the skilled artisan that in lieu of openings 44, the fluid passages can be formed as pre-pierced slits 44*a* (See FIG. 6A) provided through membrane 40. Alternately, as also seen the figure, the fluid passages can be formed as pre-pierced, pinpoint-type punctures 44*b*. Slits 44*a* or punctures 44*b* are configured such that when membrane 40 is disposed in its open position, the slits/punctures will be stretched open to provide fluid access between the open top of the bottle and the recess. Likewise, when the membrane is disposed in its closed position, slits 44*a* or punctures 44*b* will close, thereby providing a self-sealing ability to enhance the sealing provided by rib 30.

A pusher 50 is disposed within recess 24 of body 22. Pusher 50, which acts upon membrane 40 to displace the membrane to its open position, features an upper surface 53 and a lower surface 55. When pusher 50 is located in the recess, lower surface 55 is disposed for contact with central area 42 of the membrane, while upper surface 53 is held in the recess by retaining edge 38. Retaining edge 38 may prevent, for example, inadvertent withdrawal or displacement of pusher 50 from recess 24, with central area 42 preventing pusher 50 from dropping through open top 12 of the bottle.

As seen in FIG. 8, pusher 50 as illustrated in FIGS. 2–4 may be formed from a plurality of relatively flat vanes 58 affixed to a cylindrical hub 59. Pusher 50 preferably displays a height "d" less than height "b" of recess 24, both to ensure that pusher 50 is securely retained within recess 24 by action of retaining edge 38, and that the pusher will not interfere with sealing between membrane 40 and sealing rib 30. Pusher 50 preferably displays a width "e" less than width "a" of recess 24, permitting pusher 50 to move freely in recess 24 without undue interference.

To facilitate fluid flow through the recess when the pusher is present, pusher 50 preferably provides at least one fluid pathway 52 between the opposed end 36 of the luer connector hub and bottom end 28 of the recess. As herein shown, cylindrical hub 59 includes an orifice 57 formed along height "d" of the pusher. When pusher 50 is disposed in recess 24, orifice 57 establishes fluid pathway 52 in the recess. Also, any spaces defined between cylindrical hub 59 and respective vanes 58 may serve as secondary fluid pathways 52' (see FIG. 8). It will also be realized that irrespective of any orifice 57 or spaces 52' established by pusher 50, any gap created in the difference in widths "e" and "a" displayed between the pusher and the recess may also establish a fluid pathway through recess 24.

Alternate configurations of the pusher are respectively illustrated, for example, in FIGS. 9–11. In FIG. 9, pusher 80 is defined by a cylindrical body 82 formed having an orifice 81 therethrough for defining fluid pathway 52. One or more riblets 84 are configured to radiate from a bottom surface 52' of the fluid pathway. Riblets 84 are disposed for contact with central area 42 of the membrane when pusher 80 is disposed in recess 24. Riblets 84 may be spaced apart from one another to define passages 84' in between them, further serving to enhance the efficacy of fluid flow provided by fluid pathway 52.

In FIG. 10, pusher 90 is formed from a cylindrical body 92 having one or more channels 96 along length "d" of the pusher that define the fluid pathway. One or more upstanding walls 94, provided on cylindrical body 92, may be spaced apart from one another to define secondary channels 95 communicating with channels 96 of cylindrical body 92.

FIG. 11 discloses a pusher 100 somewhat similar to pusher 80 of FIG. 9, except that cylindrical body 102 is somewhat shorter than cylindrical body 82 of pusher 80. Riblets 104 like riblets 84 of pusher 80, are disposed for engagement with central area 42 of the membrane, but are formed somewhat longer than riblets 84 of pusher 80.

Resealable bottle assembly 20 may further include an external seal 70 for preserving the sterility of the various components, inclusive of drug 16, pending use. In one configuration, seal 70 features a circular end wall 72, and a cylindrical side wall 74 with an internal thread 76 configured for threadably engaging edge 35 provided with connector end 34 of the luer connector hub. A suitable sealing material 78, such as a rubber seal, may be secured to the interior face of circular end wall 72. Accordingly, seal 70 can be threadedly engaged onto luer connector hub 32 and tightened such that sealing material 78 sealingly engages open connector end 34 of the luer connector hub. Thus, a barrier is established against the passage of contaminants or other unwanted material through connector end 34 of the luer hub which (if otherwise uncovered), would provide commnunication through recess 24 and, potentially, through open top 12 of bottle 10. Also, while not illustrated, a conventional cap may be affixed to bottle 10 in a manner to cover luer connector hub 32 and engage a portion of the bottle, for instance, by a tamper evident seal.

When a practitioner desires to either introduce fluid to drug 16 held within bottle 10 or remove fluid from the bottle, luer lock seal 70 may be removed by unscrewing same from connector end 34 of the luer connector hub. Connector end 34 is thus exposed for insertion of luer tip 62 of syringe 60 (see FIG. 3). By manual force exerted by a user upon syringe 60 or, where such structure is provided, by threadedly engaging luer collar 64 with edge 35 of the luer connector hub, luer tip 62 is urged into contact against upper surface 53 of pusher 50. Under the force exerted by the luer tip, pusher 50 is urged towards the interior of bottle 10. With lower surface 55 of pusher 50 engaged against central area 42 of the membrane, it will be seen that the pusher urges membrane 40 towards the interior of bottle 10, displacing the membrane to its open position. A gap 61 is created between sealing rib 30 and central area 42, thereby opening fluid path 54 between open top 12 of the bottle and recess 24 of the body. With the opening of fluid path 54, fluid flow is fully enabled between syringe 60 and the interior of bottle 10 via: luer tip 62; fluid pathway 52 provided by the pusher; gap 61; and the one or more openings 44 provided in membrane 40.

A practitioner may now advance a plunger (not shown) associated with syringe 60, thereby supplying fluid to the interior of bottle 10. Thereafter, keeping fluid path 54 open by maintaining the connection between syringe 60 and luer connector hub 32, the practitioner may re-aspirate the now reconstituted drug 16 into syringe 60, causing the reverse fluid flow—i.e., drug 16 may flow into syringe 60 via: the one or openings 44; gap 61; fluid pathway 52; and luer tip 62. The drug 16 is thus ready for administration by the practitioner, as desired.

Where it is not desired or necessary to utilize all of drug 16 held within bottle 10, the practitioner may simply reseal bottle 10 by disengaging syringe 60 from luer connector hub 32. As exemplified by FIG. 4, by removing the force exerted by luer tip 62 upon upper surface 53 of the pusher, membrane 40 will resiliently deflect upwards towards its closed position. Recess 24 will be sealed from open top 12 of the bottle via sealing engagement between membrane 40 and sealing rib 30. Fluid path 54 will thus be closed, isolating the interior of bottle 10 from exposure with the ambient environment, thereby preserving the sterility of any drug 16 still remaining within the bottle. Also, as previously explained, depending upon the design and resiliency characteristics of membrane 40, openings 44 will also be disposed for contact with flat portion **22*a* of body 22, further preventing inadvertent fluid flow between recess 24 and open top 12 of the bottle and helping to isolate drug 16** from the ambient environment.

FIGS. 12–14 depict a second embodiment 120 of a resealable bottle assembly in accordance with the present invention. Like embodiment 20 previously described, resealable bottle assembly 120 features a body 122 including a flat portion **122*a* disposed for contact with top surface 14 of bottle 10. An upwardly extending portion 122*b* defines therein a recess 124, which will be discussed in greater detail hereinbelow. Like resealable bottle assembly 20, a membrane 40 as hereinbefore described is disposed between body 122 and top surface 14 and held in place, for instance, by crimp cap 48. Like with resealable bottle assembly 20, body 122 and bottle 10 may be formed as a unitary component. Similarly, as previously described, a luer connector hub 32 may be supplied separately from body 122 and affixed thereto; otherwise ,it may also be formed in an integral manner with body 122. Like resealable bottle assembly 20, embodiment 120 described herein may include a luer connector seal 70**, as previously described.

A principle difference between embodiments 20 and 120 of the resealable bottle assembly lies in the configurations of pusher 150 and recess 124. Recess 124 features a main portion 126 sandwiched between opposed end walls 128', 129'. While here depicted as sloping, it will be realized by the skilled artisan that end walls 128', 129' could be configured in other manners, such as rounded. Each of end walls 128', 129' terminate in respective top and bottom ends 128, 129 of the recess. Main portion 126 of recess 124 is characterized by a width "g", while each of top and bottom ends 128, 129 have a width "f" less than width "g" of the main portion. Like embodiment 20 previously described, resealable bottle assembly 120 features a sealing rib 130 formed about the periphery of bottom end 129 of recess 124.

Pusher 150 features an upper end 152 disposed outside of recess 124, thrusting through the top end of the recess towards connector end 34 of the luer connector hub. Bottom end 153 of pusher 150 is disposed for contact with central area 42 of the membrane. As seen in FIG. 15, pusher 150 may be formed from vanes 155 disposed at right angles, defining between them fluid pathways 155'. Each of vanes 155 may display a width "h" less than the width "i" displayed by the opening of luer tip 62. Accordingly, fluid will be free to flow from syringe 60, and through fluid pathways 155', for exit from recess 124 via a fluid path 154 created between recess 124 and open top 12 of bottle 10 when the membrane is urged into its open position.

Pusher 150 further includes a protrusion 158 disposed between upper and lower ends 152, 153 of the pusher. As herein showed, protrusion 158 includes sloped edges 158*a*, 158*b*. Protrusion 158 defines a width "J" less than width "G" of main portion 126, but greater than width "F" defined by top and bottom ends 128, 129 of recess 124. Thus, protrusion 158 prevents pusher 150 from inadvertent withdrawal or removal from recess 124.

By forming pusher 150 in the elongate manner herein described, it will be apparent that various sizes, lengths, and other characteristics of luer tips or other connection tips associated with the various medical delivery devices employable with the invention can be easily accommodated, absent the need for undue modification to other components associated with the assembly. By simply varying the dimensions of pusher 150, the practitioner is able to employ resealable bottle assembly 120 with many of the variously sized luer tips 62 as is conventionally available. For instance, where a syringe 60 displays a relatively short luer tip 62, pusher 150 can be lengthened, permitting the shorter luer tip to successfully actuate the membrane to its open position. It will be apparent to the skilled artisan that modifications might also be made to the pushers previously described with regard to embodiment 20 to effect the function achieved by pusher 150 herein. For instance, any of those pushers could be modified to include a portion extending through the top end of the recess.

FIG. 16 displays an alternate pusher 160 utilizable with resealable bottle assembly 120. Here, pusher 160 includes a cylindrical body 164 defining therethrough an orifice 163, establishing fluid pathway 162. Pusher 160 includes a notch 168 formed in an annular manner about cylindrical body 164. A lower end 162' of fluid pathway 162 communicates with one or more spaced ribs 166, defining between them channels 166' communicating with fluid pathway 162. Additionally, if pusher 160 were configured to eliminate fluid pathway 162—i.e., by eliminating orifice 163 and/or ribs 166, for instance-notch 168 might be configured or otherwise dimensioned for sealing contact with either of end walls 128', 129' of the recess, such that fluid flow would occur around notch 168 when the notch was spaced away from end wall 128' (or 129').

Various features of either of embodiments 20, 120 of the resealable bottle assembly may be configured in alternate manners. For example, sealing rib 30 (130) is depicted herein with a squared cross-section. However, it will be apparent to the skilled artisan that the sealing ribs may also display rounded (FIG. 20*a*) cross-sections, peaked or pointed (FIG. 20*b*) cross-sections, or any suitable configuration ensuring sealing contact between rib 30 (130) and membrane 40. Moreover, while for ease of illustration a single sealing rib 30 (130) has been shown, it will be apparent that more than one concentric sealing rib (FIG. 20*c*) may be disposed about the periphery of bottom end 28 (128) of the respective recess.

If desired, it will be apparent to the skilled artisan that in lieu of a sealing rib 30 (130) formed with the body, a sealing rib 200 may be formed as part of the structure of membrane 40 itself (see FIG. 6). Sealing rib 200 may be located between the one or more openings 40 and central area 42. Thus, rib 200 will be urged into sealing contact with flat portion 22*a* (122*a*) of the respective body when membrane 40 returns to its closed position.

The various components associated with the luer connector hub, the pusher or the body may be molded or otherwise formed from medical grade plastics, glass, or like materials. Similarly, bottle 10 may be either plastic or glass, as is conventional.

The principles of the invention are equally applicable to a rimless bottle 10', where a top surface 14' may be encompassed by the uppermost area of wall 11 surrounding open top 12' (see FIG. 17). Here, membrane 40 and body 22 (or 122) are directly affixed to top surface 14', for instance, by welding, adhesives, or mechanical methods of affixation.

It will also be evident to the skilled artisan that if, as previously described, body 22 (or 122) and bottle 10 are unitarily formed, membrane 40 may be formed with them, for instance, by a suitable co-injection process. Likewise, if membrane 40 is supplied separately from a unitarily formed bottle 10"/body 22" (or 122"), membrane 40" may be secured across the interface between recess 24" and open top 12" of the bottle, for instance, by supporting edges 46" of membrane 40" in a gap or annulus 17" defined by unitary bottle 10"/body 22" (or 122") (see FIG. 18).

Also, if desired, to enhance the efficiency of fluid flow between the bottom surface of the pusher and central area 42 of the membrane, particularly when a fluid pathway defined by the pusher directly communicates with the central area, one or more channels 43 may be provided on the central area (See FIG. 19). Channels 43 can entail spaces 45 defined between ribs 47 formed on the central area, or channels 49 incorporated in the structure of central area 42.

Moreover, it will be realized that the membrane need not be secured between the body and the top surface of the bottle. For instance, the membrane could be associated with the body itself and engaged across the open top of the bottle, for instance, by being secured in the neck of the bottle. FIG. 22 illustrates an embodiment 200 of the resealable bottle assembly substantially as hereinbefore described, albeit configured to retain the membrane against the neck of the bottle. A body 222 is provided, having a downwardly extending portion 222*b* that defines a recess 227. As hereinbefore described, pusher 250 is disposed in recess 227. Downwardly extending portion 222*b* is configured for insertion into neck portion 213 of bottle 210. Membrane 240 includes an annular bead 248 retained between neck portion 213 and a complementary groove 260 formed on downwardly extending portion 222*b*. One or more annular ribs 249 may also be provided on membrane 240 distal of annular bead 248. While body 222 may be secured to annular rim 215 via a crimp cap, as here shown, body 222 is threadedly secured to annular rim 215 via complementary threads 228, 226 formed on the annular rim and sidewall 227 of the body, respectively. As in the previously described embodiments, membrane 240 rests between the bottom end of the recess and the open top of the bottle for opening and closing of the fluid path. It will be realized that by this configuration, annular bead 248 and, if provided, the one or more annular ribs 249 may also act as a stopper for bottle 210.

It will be appreciated and understood by those skilled in the art that further and additional forms of the invention may be devised without departing from the spirit and scope of the appended claims, the invention not being limited to the specific embodiments shown

What is claimed is:

1. A resealable container assembly, comprising:

a container having an open top, an interior in fluid communication with said open top, and a top surface disposed around portions of the container surrounding said open top;

a body disposed adjacent the top surface of the container, said body defining a recess having a fluid path with the open top of the container said recess having a width, a height, and a periphery adjacent the open top of the container;

means for communicating fluid with the recess, said means having a connector end including a luer connector hub and an opposed end disposed on said body;

a membrane disposed between the open top of said container and the recess defined by said body, said membrane having a sealing area for sealing contact with the periphery of the recess and defining one or more fluid passages outside of said sealing area for fluid communication between the recess and the open top of the container, wherein said membrane is displaceable between a sealing position to close the fluid path between the recess and the open top of the container, and an open position to open the fluid path between the recess and the open top of the container; and a pusher including a cylindrical body having an orifice therethrough for defining at least one fluid pathway disposed in the recess defined by said body, said pusher having a top end disposed for contact with a syringe having a male luer tip introduced through the luer connector hub of the connector end of the means for communicating and a bottom end disposed for contact with the membrane, wherein a force urged by said male luer tip against the top end of said pusher will urge the pusher against said membrane to displace said membrane to the open position, and wherein the membrane will return to a normally sealing position when the force is removed from the pusher.

2. The resealable container assembly of claim 1, wherein said membrane comprises an elastomeric element supported between said body and the top surface of the container.

3. The resealable container assembly of claim 1, wherein said body includes a portion insertable through the open top of the container, said membrane comprising an elastomeric element extended across the recess between said body portion and the open top of the container.

4. The resealable container assembly of claim 1, wherein said pusher is entirely disposed within the recess defined by the body.

5. The resealable container assembly of claim 1, wherein the top end of the pusher is disposed through the opposed end of the means for communicating fluid.

6. The resealable container assembly of claim 1, wherein said one or more fluid passages of said membrane comprise one or more openings.

7. The resealable container assembly of claim 1, wherein said one or more fluid passages of said membrane comprise one or more slits.

8. The resealable container assembly of claim 1, wherein said body and said means for communicating fluid are formed as a unitary component.

9. The resealable container assembly of claim 1, wherein said body and said top surface are formed as a unitary component.

10. The resealable container assembly of claim 1, wherein said membrane comprises an elastomeric element supported between said body and the top surface of the container.

11. The resealable container assembly of claim 10, wherein said membrane comprises an elastomeric element supported between said body and the top surface of the container.

12. The resealable container assembly of claim 1, wherein said body includes a portion insertable through the open top of the container, said membrane comprising an elastomeric element extended across the recess and between said body portion and the open top of the container.

13. The resealable container assembly of claim 1, further comprising a sealing rib disposed about at least a portion of the periphery of said recess for contact with said sealing area of the membrane.

14. The resealable container assembly of claim 13, wherein said sealing rib comprises a rib having a square cross-section.

15. The resealable container assembly of claim 13, wherein said sealing rib comprises a rib having a peaked cross-section.

16. The resealable container assembly of claim 13, wherein said sealing rib comprises a rib having a rounded cross-section.

17. The resealable container assembly of claim 1, further comprising a plurality of sealing ribs disposed about at least a portion of the periphery of said recess for contact with said sealing area of the membrane.

18. The resealable container assembly of claim 1, further comprising a sealing rib disposed on said membrane for contact with said body outside of the periphery defined by said recess.

19. The resealable container assembly of claim 1, wherein said pusher defines one or more fluid pathways between the top and bottom ends of the pusher.

20. The resealable container assembly of claim 19, wherein said pusher has a width narrower than the width of the recess so as to define a gap between the recess and the pusher, whereby said gap comprises said at least one fluid pathway.

21. The resealable container assembly of claim 1, wherein said at least one fluid pathway comprises a fluid channel in the structure of the pusher.

22. The resealable container assembly of claim 1, wherein said top surface of the bottle comprises an annular rim disposed about the open top of said bottle.

23. The resealable container assembly of claim 22, further comprising a crimp cap for securing said body to said annular rim.

24. The resealable container assembly of claim 1, further comprising an external seal for sealing the connector end of the luer connector hub.

25. The resealable container assembly of claim 24, wherein said luer connector hub includes a top wall and an annular side wall projecting from said top wall, said annular side wall including an array of internal threads selectively engageable with the connector end of said luer connector hub, and a seal disposed between said top wall and the connector end of the luer connector hub for sealingly engaging said connector end.

26. The resealable container assembly of claim 1, wherein one or more riblets are configured to radiate from a bottom surface of the fluid pathway with the riblets disposed for contact with a central area of the membrane when the pusher is disposed in the recess.

27. The resealable container assembly of claim 26, wherein the riblets are spaced apart from one another to define passages therebetween to enhance the efficacy of fluid flow provided by the fluid pathway.

28. A resealable container assembly, comprising:

a container having an open top, an interior in fluid communication with said open top, and a top surface disposed around portions of the container surrounding said open top;

a body disposed adjacent the top surface of the container, said body defining a recess having a fluid path with the open top of the container, said recess having a width, a height, and a periphery adjacent the open top of the container;

means for communicating fluid with the recess, said means having a connector end including a luer connector hub and an opposed end disposed on said body;

a membrane disposed between the open top of said container and the recess defined by said body, said membrane having a sealing area for sealing contact with the periphery of the recess and defining one or more fluid passages outside of said sealing area for fluid communication between the recess and the open top of the container, wherein said membrane is displaceable between a sealing position to close the fluid path between the recess and the open top of the container, and an open position to open the fluid path between the recess and the open top of the container; and a pusher including a cylindrical body having one or more first channels along a length of the pusher defined by the fluid pathway disposed in the recess defined by said body and including one or more upstanding walls provided on the cylindrical body spaced apart from one another to define secondary channels communicating with the first channels of the cylindrical body, said pusher having a top end disposed for contact with a syringe having a male luer tip introduced through the luer connector hub of the connector end of the means for communicating and a bottom end disposed for contact with the membrane, wherein a force urged by said male luer tip against the top end of said pusher will urge the pusher against said membrane to displace said membrane to the open position, and wherein the membrane will return to a normally sealing position when the force is removed from the pusher.

29. The resealable container assembly of claim 28, wherein the cylindrical body of said pusher includes riblets disposed for engagement with a central area of the membrane.

* * * * *